US009441885B2

(12) United States Patent
Bayley et al.

(10) Patent No.: US 9,441,885 B2
(45) Date of Patent: Sep. 13, 2016

(54) LAVATORY WITH DUAL PLENUM HAND DRYER

(71) Applicant: Bradley IP, LLC, Menomonee Falls, WI (US)

(72) Inventors: Graeme S. Bayley, Brookfield, WI (US); Mark A. Figurski, Hartland, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 14/350,321

(22) PCT Filed: Oct. 4, 2012

(86) PCT No.: PCT/US2012/058678

§ 371 (c)(1),
(2) Date: Apr. 7, 2014

(87) PCT Pub. No.: WO2013/052616

PCT Pub. Date: Apr. 11, 2013

(65) Prior Publication Data

US 2014/0230269 A1 Aug. 21, 2014

Related U.S. Application Data

(63) Continuation of application No. 13/267,429, filed on Oct. 6, 2011, now Pat. No. 9,267,736, which is a continuation-in-part of application No. 13/088,512, filed on Apr. 18, 2011, now Pat. No. 9,170,148.

(51) Int. Cl.
*A45D 20/00* (2006.01)
*F26B 21/12* (2006.01)

(Continued)

(52) U.S. Cl.
CPC ..... *F26B 21/12* (2013.01); *A47K 4/00* (2013.01); *A47K 10/48* (2013.01); *A47K 2210/00* (2013.01)

(58) Field of Classification Search
CPC ..... A45D 20/00; A45D 20/12; A45D 20/20; F26B 25/00; F26B 21/00; F26B 21/06; F24H 1/00; E03C 1/181; A47K 10/00; A47K 10/48; A47K 5/00; A47K 5/12
USPC ..... 34/104, 105; 392/384, 385; 4/623, 628
See application file for complete search history.

(56) References Cited

U.S. PATENT DOCUMENTS 540,235 A 6/1895 Clifford et al.
D30,136 S 2/1899 Eckerson (Continued)

FOREIGN PATENT DOCUMENTS

AT 141398 8/1996
AU 2005203363 2/2006

(Continued)

*Primary Examiner* — Stephen M Gravini
(74) *Attorney, Agent, or Firm* — Boyle Fredrickson, S.C.

(57) ABSTRACT

A lavatory system includes a hand dryer with a first plenum above a basin and a second plenum incorporated within the basin. A display screen, which may be a touch-screen, can display operational data such as run time, energy consumed, water consumed, soap dispensed, soap remaining, etc. A noise-cancelling feature may actively and/or passively suppress noise from the hand dryer. Electrical energy spent by the hand dryer may also be re-captured with the use of a device within the air plenums that converts the kinetic energy of moving air into electric energy.

20 Claims, 25 Drawing Sheets

(51) Int. Cl.

| | |
|---|---|
| ***A47K 4/00*** | (2006.01) |
| ***A47K 10/48*** | (2006.01) |

(56) References Cited

U.S. PATENT DOCUMENTS

| | | | |
|---|---|---|---|
| D36,574 | S | 2/1899 | Zipp |
| D36,575 | S | 10/1903 | Zipp |
| D36,595 | S | 10/1903 | Peet |
| 937,509 | A | 10/1909 | Carpenter |
| 1,069,972 | A | 8/1913 | Metzaer |
| 1,323,398 | A | 12/1919 | Leland |
| 1,419,712 | A | 6/1922 | Bassette |
| 1,423,800 | A | 7/1922 | Hibbard et al. |
| 1,494,883 | A | 5/1924 | Bassette et al. |
| 1,578,047 | A | 3/1926 | Lum |
| 1,579,705 | A | 4/1926 | Hewitt |
| 1,616,313 | A | 2/1927 | Farmer |
| 1,659,851 | A | 2/1928 | Brewington |
| 1,750,094 | A | 3/1930 | Emmrich |
| 1,765,915 | A | 6/1930 | Haase |
| D81,754 | S | 8/1930 | Mabee |
| 1,816,055 | A | 7/1931 | Pfeifer |
| 1,961,179 | A | 6/1934 | Tinkham |
| 1,997,387 | A | 4/1935 | McCord |
| 2,008,183 | A | 7/1935 | McCord |
| 2,027,605 | A | 5/1936 | McCord et al. |
| 2,041,352 | A | 5/1936 | Jordan |
| D100,310 | S | 7/1936 | Blu |
| 2,130,196 | A | 9/1938 | Sakier |
| 2,192,383 | A | 3/1940 | Krolop |
| 2,202,107 | A | 5/1940 | Korn |
| 2,281,370 | A | 4/1942 | Morrison et al. |
| 2,328,129 | A | 8/1943 | Earle |
| 2,438,762 | A | 3/1948 | McLeckie |
| 2,470,187 | A | 5/1949 | Price |
| 2,479,571 | A | 8/1949 | Hewitt |
| 2,498,699 | A | 2/1950 | Mullett et al. |
| 2,504,740 | A | 4/1950 | Siegel |
| 2,521,769 | A | 9/1950 | Arcularius |
| 2,537,821 | A | 1/1951 | Fodor |
| 2,591,669 | A | 4/1952 | Bucknell et al. |
| 2,606,274 | A | 8/1952 | Spierer |
| RE23,674 | E | 6/1953 | Spierer et al. |
| 2,641,679 | A | 6/1953 | Brodbeck |
| 2,646,629 | A | 7/1953 | Clemens |
| D170,204 | S | 8/1953 | Long |
| 2,651,705 | A | 9/1953 | Clemens |
| 2,666,837 | A | 1/1954 | Brodbeck |
| 2,677,041 | A | 4/1954 | Oliver et al. |
| 2,698,894 | A | 1/1955 | Stein |
| 2,714,151 | A | 7/1955 | Becker |
| 2,761,222 | A | 9/1956 | Bennett |
| 2,767,407 | A | 10/1956 | Weiss |
| 2,777,934 | A | 1/1957 | Falkenthal |
| 2,826,763 | A | 3/1958 | Bass |
| 2,837,835 | A | 6/1958 | Hewitt et al. |
| 2,853,591 | A | 9/1958 | Fine |
| 2,853,592 | A | 9/1958 | Gravet |
| 2,859,535 | A | 11/1958 | Carlson |
| 2,906,627 | A | 9/1959 | Payton et al. |
| 2,908,019 | A | 10/1959 | Lyon, Jr. |
| 2,965,906 | A | 12/1960 | Mullett et al. |
| 2,973,895 | A | 3/1961 | Brown et al. |
| 2,977,455 | A | 3/1961 | Murphy |
| 3,059,815 | A | 10/1962 | Parsons, Jr. |
| 3,065,473 | A | 11/1962 | Sporck et al. |
| 3,076,887 | A | 2/1963 | Bulow |
| 3,128,161 | A | 4/1964 | Hudon |
| D201,493 | S | 6/1965 | Sundberg et al. |
| 3,220,424 | A | 11/1965 | Nelson |
| 3,305,938 | A | 2/1967 | Arthur |
| D210,131 | S | 2/1968 | Rourke |
| 3,384,977 | A | 5/1968 | Rosenberg |
| 3,409,995 | A | 11/1968 | Greenwood et al. |
| 3,415,278 | A | 12/1968 | Yamamoto et al. |
| 3,449,838 | A | 6/1969 | Chancellor |
| 3,480,787 | A | 11/1969 | Johansen |
| 3,487,477 | A | 1/1970 | Classen |
| 3,491,381 | A | 1/1970 | Catheart |
| 3,502,384 | A | 3/1970 | Gipson |
| 3,505,692 | A | 4/1970 | Forbes |
| 3,523,305 | A | 8/1970 | Zorn |
| 3,536,294 | A | 10/1970 | Rodriguez |
| 3,551,919 | A | 1/1971 | Forbes |
| 3,556,158 | A | 1/1971 | Schneider |
| 3,575,583 | A | 4/1971 | Brown |
| 3,575,640 | A | 4/1971 | Ishikawa |
| 3,576,277 | A | 4/1971 | Blackmon |
| 3,585,652 | A | 6/1971 | Forbes et al. |
| 3,585,653 | A | 6/1971 | Forbes et al. |
| 3,587,177 | A | 6/1971 | Overly et al. |
| 3,588,038 | A | 6/1971 | Tanaka |
| 3,603,002 | A | 9/1971 | Spierer |
| 3,613,124 | A | 10/1971 | Ichimori et al. |
| 3,621,199 | A | 11/1971 | Goldstein |
| 3,639,920 | A | 2/1972 | Griffin et al. |
| 3,643,346 | A | 2/1972 | Lester |
| 3,699,984 | A | 10/1972 | Davis |
| 3,711,958 | A | 1/1973 | Lepage |
| 3,724,001 | A | 4/1973 | Ichimori et al. |
| 3,744,149 | A | 7/1973 | Helbling |
| 3,746,035 | A | 7/1973 | Singer |
| 3,757,806 | A | 9/1973 | Bhaskar et al. |
| 3,817,651 | A | 6/1974 | Law et al. |
| 3,878,621 | A | 4/1975 | Duerre |
| 3,904,167 | A | 9/1975 | Touch et al. |
| 3,906,795 | A | 9/1975 | Kask |
| 3,918,987 | A | 11/1975 | Kopfer |
| D238,075 | S | 12/1975 | Harris |
| 3,975,781 | A | 8/1976 | Klimboff et al. |
| 3,992,730 | A | 11/1976 | Davis |
| 4,072,157 | A | 2/1978 | Wines, Jr. et al. |
| 4,120,180 | A | 10/1978 | Jedora |
| 4,144,596 | A | 3/1979 | MacFarlane et al. |
| 4,145,602 | A | 3/1979 | Lee |
| 4,145,769 | A | 3/1979 | MacFarlane et al. |
| D251,795 | S | 5/1979 | McCann |
| 4,193,209 | A | 3/1980 | Lovison et al. |
| 4,195,416 | A | 4/1980 | Hall |
| 4,219,367 | A | 8/1980 | Cary, Jr. et al. |
| 4,239,555 | A | 12/1980 | Scharlack et al. |
| 4,256,133 | A | 3/1981 | Coward et al. |
| D260,678 | S | 9/1981 | Hiller |
| 4,295,233 | A | 10/1981 | Hinkel et al. |
| 4,309,781 | A | 1/1982 | Lissau |
| 4,336,619 | A | 6/1982 | Hinkel et al. |
| 4,375,874 | A | 3/1983 | Leotta et al. |
| 4,383,377 | A | 5/1983 | Crafton |
| 4,398,310 | A | 8/1983 | Lienhard |
| 4,402,095 | A | 9/1983 | Pepper |
| 4,402,331 | A | 9/1983 | Taldo et al. |
| D272,263 | S | 1/1984 | Lienhard |
| 4,429,422 | A | 2/1984 | Warcham |
| 4,453,286 | A | 6/1984 | Wieland |
| 4,461,439 | A | 7/1984 | Rose |
| 4,497,999 | A | 2/1985 | Postbeschild |
| 4,509,543 | A | 4/1985 | Livingston et al. |
| D279,404 | S | 6/1985 | Hiller |
| 4,520,516 | A | 6/1985 | Parsons |
| 4,541,563 | A | 9/1985 | Uetsuhara |
| 4,570,823 | A | 2/1986 | Arabian et al. |
| 4,594,797 | A | 6/1986 | Houck, Jr. |
| 4,598,726 | A | 7/1986 | Pepper |
| 4,604,764 | A | 8/1986 | Enzo |
| 4,606,085 | A | 8/1986 | Davies |
| 4,610,165 | A | 9/1986 | Duffy et al. |
| 4,611,768 | A | 9/1986 | Voss et al. |
| 4,624,017 | A | 11/1986 | Foletta |
| 4,637,254 | A | 1/1987 | Dyben et al. |
| 4,642,821 | A | 2/1987 | Zanuso et al. |
| 4,642,909 | A | 2/1987 | Garcial |
| 4,644,256 | A | 2/1987 | Farias et al. |
| 4,651,777 | A | 3/1987 | Hardman |
| 4,653,201 | A | 3/1987 | Seaman |

(56) References Cited

U.S. PATENT DOCUMENTS 4,670,010 A 6/1987 Dragone
4,671,121 A 6/1987 Schieler
4,681,141 A 7/1987 Wang
4,682,628 A 7/1987 Hill
4,685,222 A 8/1987 Houck, Jr.
4,688,277 A 8/1987 Kakinoki et al.
4,688,585 A 8/1987 Vetter
4,700,049 A 10/1987 Rubin
4,702,107 A 10/1987 Guerrini et al.
4,707,867 A 11/1987 Kawabe et al.
4,707,933 A 11/1987 Keck et al.
4,709,728 A 12/1987 Ying-Chung
4,716,605 A 1/1988 Shepherd et al.
4,722,372 A 2/1988 Hoffman et al.
4,735,002 A 4/1988 Rath
4,735,357 A 4/1988 Gregory et al.
4,741,363 A 5/1988 Hu
4,742,583 A 5/1988 Yoshida et al.
4,742,836 A 5/1988 Buehler
4,744,515 A 5/1988 Watanabe
4,746,090 A 5/1988 Hamilton
4,762,273 A 8/1988 Gregory et al.
4,765,003 A 8/1988 Chang
4,767,922 A 8/1988 Stauffer
4,769,863 A 9/1988 Tegg et al.
4,780,595 A 10/1988 Alban
4,785,162 A 11/1988 Kuo
4,823,414 A 4/1989 Piersimoni et al.
4,826,129 A 5/1989 Fong et al.
4,839,039 A 6/1989 Parsons et al.
4,848,599 A 7/1989 Kano et al.
4,852,802 A 8/1989 Iggulden et al.
4,856,122 A 8/1989 Pilolla
4,857,112 A 8/1989 Franninge
4,857,705 A 8/1989 Blevins
4,872,485 A 10/1989 Laverty, Jr.
4,876,435 A 10/1989 Hawkins
4,882,467 A 11/1989 Dimick
4,883,749 A 11/1989 Roberts et al.
4,889,315 A 12/1989 Imanaga
4,894,874 A 1/1990 Wilson
4,909,580 A 3/1990 Mitchell
4,914,758 A 4/1990 Shaw
4,914,833 A 4/1990 Pilolla et al.
4,915,347 A 4/1990 Iqbal et al.
4,916,382 A 4/1990 Kent
4,916,613 A 4/1990 Lange et al.
4,921,129 A 5/1990 Jones et al.
4,921,131 A 5/1990 Binderbauer et al.
4,921,211 A 5/1990 Novak et al.
4,940,298 A 7/1990 Jackson et al.
4,941,219 A 7/1990 Van Marcke
4,942,631 A 7/1990 Rosa
4,948,090 A 8/1990 Chen
4,953,236 A 9/1990 Lee et al.
4,954,179 A 9/1990 Franninge
4,955,535 A 9/1990 Tsutsui et al.
4,959,603 A 9/1990 Yamamoto et al.
4,963,780 A 10/1990 Hochstrasser
4,967,425 A 11/1990 Kawamura et al.
4,971,106 A 11/1990 Tsutsui et al.
4,980,474 A 12/1990 Hayasjo et al.
4,980,574 A 12/1990 Cirrito
4,984,314 A 1/1991 Weigert
4,986,221 A 1/1991 Shaw
4,989,755 A 2/1991 Shiau
4,995,585 A 2/1991 Gruber et al.
4,998,673 A 3/1991 Pilolla
5,000,044 A 3/1991 Duffy et al.
5,008,963 A 4/1991 Stein
5,018,550 A 5/1991 Burdorff
5,025,516 A 6/1991 Wilson
5,031,258 A 7/1991 Shaw
5,031,337 A 7/1991 Pilolla et al.
5,033,508 A 7/1991 Laverty, Jr.
5,033,715 A 7/1991 Chiang et al.
5,060,323 A 10/1991 Shaw
5,062,164 A 11/1991 Lee et al.
5,063,622 A 11/1991 Tsutsui et al.
5,063,955 A 11/1991 Sakakibara
5,072,618 A 12/1991 Taylor et al.
5,074,322 A 12/1991 Jaw
5,074,520 A 12/1991 Lee et al.
5,076,424 A 12/1991 Nakamura
5,080,324 A 1/1992 Chi
RE33,810 E 2/1992 Streiter
5,084,984 A 2/1992 Duchoud et al.
5,086,526 A 2/1992 Van Marcke
5,092,560 A 3/1992 Chen
5,095,941 A 3/1992 Betz
5,099,587 A 3/1992 Jarosch
5,111,594 A 5/1992 Allen
D326,711 S 6/1992 Lotito et al.
5,117,693 A 6/1992 Duska
5,133,095 A 7/1992 Shiba et al.
5,144,757 A 9/1992 Sasso
5,146,695 A 9/1992 Yang
5,158,114 A 10/1992 Botsolas
5,163,234 A 11/1992 Tsukamoto et al.
5,169,118 A 12/1992 Whiteside
5,170,944 A 12/1992 Shirai
D332,194 S 1/1993 Hines
D332,195 S 1/1993 Hines
D332,196 S 1/1993 Hines
D332,365 S 1/1993 Hines
D332,366 S 1/1993 Hines
D332,369 S 1/1993 Hanna et al.
D332,370 S 1/1993 Hanna et al.
D332,542 S 1/1993 Hines
D332,679 S 1/1993 Hines
D332,849 S 1/1993 Hines
5,175,892 A 1/1993 Shaw
5,177,879 A 1/1993 Muta
5,181,328 A 1/1993 Bouverie
D332,889 S 2/1993 Hines
5,184,642 A 2/1993 Powell
5,186,360 A 2/1993 Mease et al.
D334,266 S 3/1993 Hines
5,193,563 A 3/1993 Melech
5,199,116 A 4/1993 Fischer
5,199,118 A 4/1993 Cole et al.
5,199,188 A 4/1993 Franz
5,202,666 A 4/1993 Knippscheer
D336,572 S 6/1993 Gunderson et al.
5,216,251 A 6/1993 Matschke
5,217,035 A 6/1993 Van Marcke
5,224,685 A 7/1993 Chiang et al.
5,226,629 A 7/1993 Millman et al.
5,230,109 A 7/1993 Zaccai et al.
D338,361 S 8/1993 Hines
5,239,610 A 8/1993 Shao
5,243,717 A 9/1993 Yasuo
D340,374 S 10/1993 Hines
D340,375 S 10/1993 Hines
5,251,872 A 10/1993 Kodaira
5,253,376 A 10/1993 Fait
5,255,822 A 10/1993 Mease et al.
D341,724 S 11/1993 Hines
5,257,423 A 11/1993 Jacobsen et al.
5,259,410 A 11/1993 Trueb et al.
5,265,288 A 11/1993 Allison
5,265,628 A 11/1993 Sage et al.
D342,175 S 12/1993 Hines
D342,177 S 12/1993 Hanna et al.
5,267,475 A 12/1993 Gaston
5,269,071 A 12/1993 Hamabe et al.
5,272,918 A 12/1993 Gaston et al.
D342,992 S 1/1994 Robertson
5,280,679 A 1/1994 Edelman
D344,830 S 3/1994 Carter et al.
5,341,839 A 8/1994 Kobayashi et al.
5,347,864 A 9/1994 Senghaas et al.
5,351,347 A 10/1994 Kunkel
5,351,417 A 10/1994 Rubin

(56) References Cited

U.S. PATENT DOCUMENTS 5,362,026 A 11/1994 Kobayashi et al.
5,363,517 A 11/1994 Botsolas
5,367,442 A 11/1994 Frost et al.
5,369,818 A 12/1994 Barnum et al.
5,377,424 A 1/1995 Albanes
5,377,427 A 1/1995 Mashata
D355,949 S 2/1995 Laughton
5,397,099 A 3/1995 Pilolla
5,404,419 A 4/1995 Artis, Jr.
5,412,816 A 5/1995 Paterson et al.
5,412,818 A 5/1995 Chen
5,426,271 A 6/1995 Clark et al.
D361,372 S 8/1995 Enthoven
5,438,714 A 8/1995 Shaw
5,438,763 A 8/1995 Yang
5,442,867 A 8/1995 Robinson
D362,901 S 10/1995 Dannenberg et al.
5,459,944 A 10/1995 Tatsutani et al.
D364,675 S 11/1995 Tebbe
5,477,984 A 12/1995 Sayama et al.
5,482,250 A 1/1996 Kodaira
5,497,135 A 3/1996 Wisskirchen et al.
5,504,950 A 4/1996 Natalizia et al.
5,514,346 A 5/1996 Fujita
5,522,411 A 6/1996 Johnson
5,548,119 A 8/1996 Nortier
5,555,912 A 9/1996 Saadi et al.
5,561,871 A 10/1996 Laughton
5,566,404 A 10/1996 Laughton
5,570,869 A 11/1996 Diaz et al.
5,586,746 A 12/1996 Humpert et al.
5,588,636 A 12/1996 Eichholz et al.
5,595,216 A 1/1997 Pilolla
5,610,591 A 3/1997 Gallagher
5,611,093 A 3/1997 Barnum et al.
5,611,517 A 3/1997 Saadi et al.
5,625,908 A 5/1997 Shaw
5,627,375 A 5/1997 Hsieh
5,640,781 A 6/1997 Carson
5,642,462 A 6/1997 Huff
D380,529 S 7/1997 Laughton
5,651,189 A 7/1997 Coykendall et al.
5,651,384 A 7/1997 Rudrich
5,670,945 A 9/1997 Applonie
5,681,630 A 10/1997 Smick et al.
D387,144 S 12/1997 Flaherty
5,694,653 A 12/1997 Harald
5,699,833 A 12/1997 Tsataros
5,701,929 A 12/1997 Helmsderfer
5,727,579 A 3/1998 Chardack
5,730,165 A 3/1998 Philipp
D393,700 S 4/1998 Trueb et al.
5,743,511 A 4/1998 Eichholz et al.
D394,495 S 5/1998 Hauser
5,758,688 A 6/1998 Hamanaka et al.
5,765,242 A 6/1998 Marciano
5,769,120 A 6/1998 Laverty, Jr. et al.
5,781,942 A 7/1998 Allen et al.
5,782,382 A 7/1998 Van Marcke
D398,969 S 9/1998 Hauser, II
5,813,047 A 9/1998 Teichroeb
5,819,335 A 10/1998 Hennessy
5,819,336 A 10/1998 Gilliam et al.
5,829,072 A 11/1998 Hirsch et al.
D402,358 S 12/1998 Bonnell
5,855,356 A 1/1999 Fait
5,868,311 A 2/1999 Cretu-Petra
5,873,178 A 2/1999 Johnson
5,875,562 A 3/1999 Fogarty
5,893,387 A 4/1999 Paterson et al.
5,915,417 A 6/1999 Diaz et al.
5,915,851 A 6/1999 Wattrick et al.
D411,876 S 7/1999 Hafner et al.
5,918,855 A 7/1999 Hamanaka et al.
5,924,148 A 7/1999 Flowers, Sr.
5,943,712 A 8/1999 Van Marcke
5,943,713 A 8/1999 Paterson et al.
5,945,068 A 8/1999 Ferone
5,945,913 A 8/1999 Gallagher
5,950,983 A 9/1999 Jahrling
5,954,069 A 9/1999 Foster
5,961,095 A 10/1999 Schrott
5,966,753 A 10/1999 Gauthier et al.
5,972,126 A 10/1999 Fernie
5,974,685 A 11/1999 Hironaka
5,979,500 A 11/1999 Jahrling et al.
5,984,262 A 11/1999 Parsons et al.
5,988,588 A 11/1999 Allen et al.
5,992,430 A 11/1999 Chardack et al.
6,000,429 A 12/1999 Van Marcke
6,003,170 A 12/1999 Humpert et al.
6,006,388 A 12/1999 Young
6,006,784 A 12/1999 Tsutsui et al.
D420,727 S 2/2000 Hundley
6,018,885 A 2/2000 Hill
6,029,292 A 2/2000 Leiferman et al.
6,029,293 A 2/2000 Paterson et al.
6,038,786 A 3/2000 Aisenberg et al.
D422,346 S 4/2000 Svendsen
6,056,261 A 5/2000 Aparicio et al.
6,059,192 A 5/2000 Zosimadis
6,067,673 A 5/2000 Paese et al.
D428,477 S 7/2000 O'Connel et al.
6,082,407 A 7/2000 Paterson et al.
6,089,086 A 7/2000 Swindler et al.
6,110,292 A 8/2000 Jewett et al.
D431,288 S 9/2000 Helmsderfer
6,119,285 A 9/2000 Kim
D433,109 S 10/2000 Wilke et al.
6,125,482 A 10/2000 Foster
6,127,671 A 10/2000 Parsons et al.
6,128,826 A 10/2000 Robinson
6,131,587 A 10/2000 Chardack et al.
6,142,342 A 11/2000 Lewis
6,161,227 A 12/2000 Bargenquast
6,161,814 A 12/2000 Jahrling
D435,893 S 1/2001 Helmsderfer
6,178,572 B1 1/2001 Van Marcke
6,185,838 B1 2/2001 Moore
6,189,163 B1 2/2001 Van Marcke
6,189,230 B1 2/2001 Huen
6,192,530 B1 2/2001 Dai
6,199,428 B1 3/2001 Estevez-Garcia et al.
6,202,980 B1 3/2001 Vincent et al.
6,206,340 B1 3/2001 Paese et al.
6,209,392 B1 4/2001 Rapala
6,212,707 B1 4/2001 Thompson et al.
6,216,534 B1 4/2001 Ross, Jr. et al.
6,219,857 B1 4/2001 Wu
6,219,859 B1 4/2001 Derakhshan
6,236,317 B1 5/2001 Cohen et al.
6,250,601 B1 6/2001 Kolar et al.
6,253,609 B1 7/2001 Ross, Jr. et al.
6,253,611 B1 7/2001 Varga et al.
6,257,264 B1 7/2001 Sturman et al.
6,267,007 B1 7/2001 Gunther
D446,664 S 8/2001 Petri
D447,224 S 8/2001 Hauser, II
6,269,695 B1 8/2001 Cesternino et al.
6,273,394 B1 8/2001 Vincent et al.
6,279,179 B1 8/2001 Register
6,279,587 B1 8/2001 Yamamoto
6,282,812 B1 9/2001 Wee et al.
6,286,153 B1 9/2001 Keller
6,289,728 B1 9/2001 Wilkins
6,294,786 B1 9/2001 Marcichow et al.
6,295,410 B1 9/2001 Helms et al.
D448,585 S 10/2001 Petri
6,298,502 B1 10/2001 Brown
6,317,717 B1 11/2001 Lindsey et al.
6,321,785 B1 11/2001 Bergmann
6,322,005 B1 11/2001 Kern et al.
6,340,032 B1 1/2002 Zosimadis
6,341,389 B2 1/2002 Philipps-Libeich et al.

(56) References Cited

U.S. PATENT DOCUMENTS

| | | | |
|---|---|---|---|
| D453,882 | S | 2/2002 | Petri |
| 6,349,484 | B1 | 2/2002 | Cohen |
| 6,351,866 | B1 | 3/2002 | Bragulla |
| 6,363,549 | B2 | 4/2002 | Humpert et al. |
| 6,370,951 | B1 | 4/2002 | Kerchaert et al. |
| 6,386,390 | B1 | 5/2002 | Tinker |
| 6,390,125 | B2 | 5/2002 | Pawelzik et al. |
| 6,393,634 | B1 | 5/2002 | Kodaira et al. |
| 6,401,274 | B1 | 6/2002 | Brown |
| 6,408,881 | B2 | 6/2002 | Lorenzelli et al. |
| 6,418,788 | B2 | 7/2002 | Articolo |
| 6,426,701 | B1 | 7/2002 | Levy et al. |
| 6,431,189 | B1 | 8/2002 | Deibert |
| D462,195 | S | 9/2002 | Wang |
| RE37,888 | E | 10/2002 | Cretu-Petra |
| 6,467,514 | B1 | 10/2002 | Korst et al. |
| 6,467,651 | B1 | 10/2002 | Muderlak et al. |
| 6,481,040 | B1 | 11/2002 | McIntyre |
| 6,481,634 | B1 | 11/2002 | Zosimadis |
| 6,484,965 | B1 | 11/2002 | Reaves |
| 6,508,121 | B2 | 1/2003 | Eck |
| 6,523,193 | B2 | 2/2003 | Saraya |
| 6,523,404 | B1 | 2/2003 | Murphy et al. |
| 6,568,655 | B2 | 5/2003 | Paese et al. |
| 6,572,207 | B2 | 6/2003 | Hase et al. |
| D477,060 | S | 7/2003 | Loberger et al. |
| 6,598,245 | B2 | 7/2003 | Nishioka |
| 6,619,320 | B2 | 9/2003 | Parsons |
| 6,624,606 | B2 | 9/2003 | Kushida et al. |
| 6,639,209 | B1 | 10/2003 | Patterson et al. |
| D481,826 | S | 11/2003 | Martinuzzo et al. |
| 6,641,002 | B2 | 11/2003 | Gerenraich et al. |
| 6,643,865 | B2 | 11/2003 | Bork et al. |
| 6,651,851 | B2 | 11/2003 | Muderlak et al. |
| D483,152 | S | 12/2003 | Martinuzzo et al. |
| 6,658,934 | B1 | 12/2003 | Housey et al. |
| D484,958 | S | 1/2004 | Loberger et al. |
| 6,671,890 | B2 | 1/2004 | Nishioka |
| 6,671,898 | B1 | 1/2004 | Eggenberger et al. |
| 6,679,285 | B2 | 1/2004 | Pablo |
| 6,691,340 | B2 | 2/2004 | Honda et al. |
| 6,691,724 | B2 | 2/2004 | Ford |
| 6,711,949 | B1 | 3/2004 | Sorenson |
| 6,711,950 | B1 | 3/2004 | Yamaura et al. |
| 6,715,730 | B2 | 4/2004 | Ehr |
| 6,766,589 | B1 | 7/2004 | Bory et al. |
| 6,769,197 | B1 | 8/2004 | Tai |
| 6,769,443 | B2 | 8/2004 | Bush |
| 6,770,869 | B2 | 8/2004 | Patterson et al. |
| D496,450 | S | 9/2004 | Loberger et al. |
| 6,789,197 | B1 | 9/2004 | Saito |
| 6,812,657 | B2 | 11/2004 | Raimondi |
| 6,827,294 | B1 | 12/2004 | Fan et al. |
| 6,843,079 | B2 | 1/2005 | Hird |
| 6,857,314 | B2 | 2/2005 | Ohhashi et al. |
| 6,871,541 | B2 | 3/2005 | Weisse |
| 6,882,278 | B2 | 4/2005 | Winings et al. |
| 6,883,563 | B2 | 4/2005 | Smith |
| D507,634 | S | 7/2005 | Loberger et al. |
| 6,912,864 | B2 | 7/2005 | Roche et al. |
| 6,915,690 | B2 | 7/2005 | Okada et al. |
| 6,922,144 | B2 | 7/2005 | Bulin et al. |
| D508,117 | S | 8/2005 | Loberger et al. |
| 6,922,912 | B2 | 8/2005 | Phillips |
| 6,928,235 | B2 | 8/2005 | Pollack |
| 6,929,150 | B2 | 8/2005 | Muderlak et al. |
| D509,577 | S | 9/2005 | Loberger et al. |
| 6,950,606 | B2 | 9/2005 | Logan et al. |
| D511,205 | S | 11/2005 | Loberger et al. |
| D511,821 | S | 11/2005 | Loberger et al. |
| 6,962,005 | B1 | 11/2005 | Khosropour et al. |
| 6,962,168 | B2 | 11/2005 | McDaniel et al. |
| 6,964,405 | B2 | 11/2005 | Marcichow et al. |
| 6,966,334 | B2 | 11/2005 | Bolster |
| 6,968,860 | B1 | 11/2005 | Haenlein et al. |
| D512,648 | S | 12/2005 | Smith et al. |
| 6,980,126 | B2 | 12/2005 | Fournier |
| 6,986,171 | B1 | 1/2006 | Perrin |
| 6,993,968 | B2 | 2/2006 | Kogure |
| 6,996,863 | B2 | 2/2006 | Kaneko |
| 7,007,318 | B1 | 3/2006 | Bork et al. |
| 7,014,166 | B1 | 3/2006 | Wang |
| 7,018,473 | B2 | 3/2006 | Shadrach, III |
| 7,039,301 | B1 | 5/2006 | Aisenberg et al. |
| 7,039,963 | B2 | 5/2006 | Loberger et al. |
| 7,079,037 | B2 | 7/2006 | Ross, Jr. et al. |
| D526,394 | S | 8/2006 | Loberger et al. |
| D527,085 | S | 8/2006 | Loberger et al. |
| 7,082,828 | B1 | 8/2006 | Wilkins |
| 7,093,485 | B2 | 8/2006 | Newman et al. |
| D527,809 | S | 9/2006 | Loberger et al. |
| 7,104,519 | B2 | 9/2006 | O'Maley et al. |
| 7,107,631 | B2 | 9/2006 | Lang et al. |
| 7,114,510 | B2 | 10/2006 | Peters et al. |
| 7,150,293 | B2 | 12/2006 | Jonte |
| 7,165,450 | B2 | 1/2007 | Jamnia et al. |
| 7,174,577 | B2 | 2/2007 | Jost et al. |
| D537,927 | S | 3/2007 | Loberger et al. |
| D538,898 | S | 3/2007 | Trepanier |
| D539,400 | S | 3/2007 | Loberger et al. |
| 7,191,484 | B2 | 3/2007 | Dawe |
| 7,191,920 | B2 | 3/2007 | Boll et al. |
| 7,198,175 | B2 | 4/2007 | Ophardt |
| 7,201,052 | B2 | 4/2007 | Lee |
| D542,474 | S | 5/2007 | Churchill et al. |
| 7,219,686 | B2 | 5/2007 | Schmitz et al. |
| 7,228,874 | B2 | 6/2007 | Bolderheij et al. |
| 7,228,984 | B2 | 6/2007 | Tack et al. |
| 7,232,111 | B2 | 6/2007 | McDaniel et al. |
| 7,242,307 | B1 | 7/2007 | LeBlond et al. |
| 7,271,728 | B2 | 9/2007 | Taylor et al. |
| 7,278,624 | B2 | 10/2007 | Iott et al. |
| 7,296,765 | B2 | 11/2007 | Rodrain |
| 7,305,722 | B2 | 12/2007 | Sha et al. |
| 7,315,165 | B2 | 1/2008 | Kleinen et al. |
| 7,318,949 | B2 | 1/2008 | Shadrach, III |
| 7,320,146 | B2 | 1/2008 | Nortier et al. |
| D561,315 | S | 2/2008 | Loberger et al. |
| 7,343,799 | B2 | 3/2008 | Nagakura et al. |
| 7,350,245 | B2 | 4/2008 | Giagni |
| 7,377,163 | B2 | 5/2008 | Miyagawa |
| 7,396,000 | B2 | 7/2008 | Parsons et al. |
| 7,406,722 | B2 | 8/2008 | Fukuizumi et al. |
| 7,409,860 | B2 | 8/2008 | Ferreira et al. |
| 7,437,833 | B2 | 10/2008 | Sato et al. |
| 7,443,305 | B2 | 10/2008 | Verdiramo |
| 7,451,894 | B2 | 11/2008 | Ophardt |
| 7,455,197 | B2 | 11/2008 | Ophardt |
| 7,458,261 | B2 | 12/2008 | Miyagawa |
| 7,464,418 | B2 | 12/2008 | Seggio et al. |
| 7,467,550 | B2 | 12/2008 | Betz, II et al. |
| 7,471,883 | B2 | 12/2008 | Seutter et al. |
| 7,472,433 | B2 | 1/2009 | Rodenbeck et al. |
| 7,477,148 | B2 | 1/2009 | Lynn et al. |
| 7,484,409 | B2 | 2/2009 | Dykstra et al. |
| D588,676 | S | 3/2009 | Loberger et al. |
| 7,516,939 | B2 | 4/2009 | Bailey |
| D591,839 | S | 5/2009 | Loberger et al. |
| 7,527,174 | B2 | 5/2009 | Meehan et al. |
| 7,530,269 | B2 | 5/2009 | Newman et al. |
| 7,533,787 | B2 | 5/2009 | Muderlak et al. |
| 7,537,195 | B2 | 5/2009 | McDaniel et al. |
| 7,555,209 | B2 | 6/2009 | Pradas Diez et al. |
| D599,059 | S | 8/2009 | Clerch |
| 7,588,168 | B2 | 9/2009 | Bagwell et al. |
| 7,596,883 | B2 | 10/2009 | Kameishi |
| 7,597,122 | B1 | 10/2009 | Smith |
| 7,607,442 | B2 | 10/2009 | Barnhill et al. |
| 7,607,443 | B2 | 10/2009 | Barnhill et al. |
| 7,614,096 | B2 | 11/2009 | Vincent |
| 7,614,160 | B2 | 11/2009 | Kameishi et al. |
| 7,617,830 | B2 | 11/2009 | Barnhill et al. |
| 7,627,909 | B2 | 12/2009 | Esche |
| 7,631,372 | B2 | 12/2009 | Marty et al. |

(56) References Cited

U.S. PATENT DOCUMENTS 7,641,173 B2 1/2010 Goodman
7,641,740 B2 1/2010 Barnhill et al.
7,650,653 B2 1/2010 Johnson et al.
7,651,068 B2 1/2010 Bailey
D610,242 S 2/2010 Loberger et al.
7,657,162 B2 2/2010 Itoigawa et al.
7,659,824 B2 2/2010 Prodanovich et al.
7,681,447 B2 3/2010 Nagakura et al.
7,682,464 B2 3/2010 Glenn et al.
D614,273 S 4/2010 Loberger et al.
7,690,395 B2 4/2010 Jonte et al.
7,690,623 B2 4/2010 Parsons et al.
7,698,770 B2 4/2010 Barnhill et al.
7,701,164 B2 4/2010 Clothier et al.
7,721,602 B2 5/2010 Benner et al.
7,726,334 B2 6/2010 Ross, Jr. et al.
7,731,154 B2 6/2010 Parsons et al.
7,743,438 B2 6/2010 Chen
7,743,782 B2 6/2010 Jost
7,750,594 B2 7/2010 Clothier et al.
7,754,021 B2 7/2010 Barnhill et al.
7,754,022 B2 7/2010 Barnhill et al.
7,757,700 B2 7/2010 Barnhill et al.
7,758,701 B2 7/2010 Barnhill et al.
7,766,026 B2 8/2010 Boey
7,766,194 B2 8/2010 Boll et al.
7,774,953 B1 8/2010 Duran
7,784,481 B2 8/2010 Kunkel
7,786,628 B2 8/2010 Childe et al.
7,789,095 B2 9/2010 Barnhill et al.
7,797,769 B2 9/2010 Ozenick
7,804,409 B2 9/2010 Munro et al.
D625,792 S 10/2010 Rundberg et al.
7,812,598 B2 10/2010 Yasuda et al.
7,814,582 B2 10/2010 Reddy et al.
7,815,134 B2 10/2010 Hohl
7,818,083 B2 10/2010 Glenn et al.
7,819,136 B1 10/2010 Eddy
D628,280 S 11/2010 Loberger et al.
7,825,564 B2 11/2010 Croft et al.
RE42,005 E 12/2010 Jost et al.
D629,877 S 12/2010 Rundberg
7,856,736 B2 12/2010 Churchill et al.
7,860,671 B1 12/2010 LaCaze
D633,992 S 3/2011 Rundberg et al.
D637,350 S 5/2011 Kato et al.
7,944,116 B2 5/2011 Causier
7,946,055 B2 5/2011 Churchill et al.
7,971,368 B2 7/2011 Fukaya et al.
8,037,619 B2 10/2011 Liu
8,043,714 B2 10/2011 Hashimoto
8,064,756 B2 11/2011 Liu
8,128,465 B2 3/2012 Collins
8,136,262 B2 3/2012 Collins
1,661,023 A1 5/2012 Liu et al.
8,296,875 B2 * 10/2012 Loberger ..... E03C 1/057 4/623
8,561,626 B2 10/2013 Sawaski et al.
8,698,333 B2 4/2014 Glasser et al.
8,944,105 B2 2/2015 Rodenbeck et al.
8,950,019 B2 * 2/2015 Loberger ..... E03C 1/01 4/619
2001/0011389 A1 8/2001 Philipps-Liebich et al.
2001/0011390 A1 8/2001 Humpert et al.
2001/0020619 A1 9/2001 Pfeifer et al.
2002/0006275 A1 1/2002 Pollack
2002/0019709 A1 2/2002 Segal
2002/0104159 A1 8/2002 Nishioka
2002/0157176 A1 10/2002 Wawrla et al.
2002/0171056 A1 11/2002 Paese et al.
2003/0037612 A1 2/2003 Nagakura et al.
2003/0172547 A1 9/2003 Shepard
2003/0188380 A1 10/2003 Loberger et al.
2003/0210140 A1 11/2003 Menard et al.
2003/0213062 A1 11/2003 Honda et al.
2004/0016296 A1 1/2004 Weisse
2004/0025248 A1 2/2004 Lang et al.
2004/0083547 A1 5/2004 Mercier
2004/0128755 A1 7/2004 Loberger et al.
2004/0129075 A1 7/2004 Sorenson
2004/0143898 A1 7/2004 Jost et al.
2004/0149779 A1 8/2004 Boll et al.
2004/0182151 A1 9/2004 Meure
2004/0221645 A1 11/2004 Brzozowski et al.
2004/0221646 A1 11/2004 Ohhashi et al.
2004/0221647 A1 11/2004 Sabatino
2004/0238660 A1 12/2004 Fan et al.
2005/0000015 A1 1/2005 Kaneko
2005/0087557 A1 4/2005 Oliver et al.
2005/0098968 A1 5/2005 Dyson et al.
2005/0199843 A1 9/2005 Jost et al.
2005/0205818 A1 9/2005 Bayley et al.
2006/0098961 A1 5/2006 Seutter et al.
2006/0101575 A1 5/2006 Louis
2006/0102642 A1 5/2006 Muntzing et al.
2006/0145111 A1 7/2006 Lang et al.
2006/0150316 A1 7/2006 Fukuizumi et al.
2006/0151513 A1 7/2006 Shadrach, III
2006/0185074 A1 8/2006 Loberger et al.
2006/0200903 A1 9/2006 Rodenbeck et al.
2006/0207019 A1 9/2006 Vincent
2006/0225200 A1 10/2006 Wierenga
2006/0272170 A1 12/2006 Holmes
2007/0023565 A1 2/2007 Babikian
2007/0079524 A1 4/2007 Sato et al.
2007/0094787 A1 5/2007 Hwang
2007/0144034 A1 6/2007 Kameishi
2007/0151338 A1 7/2007 Benner et al.
2007/0152082 A1 7/2007 Hyslop
2007/0194637 A1 8/2007 Childe et al.
2007/0230839 A1 10/2007 Childe et al.
2007/0252551 A1 11/2007 Clothier et al.
2007/0261162 A1 11/2007 Atkinson
2007/0263994 A1 11/2007 Diez et al.
2007/0278983 A1 12/2007 Clothier et al.
2008/0005833 A1 1/2008 Bayley et al.
2008/0018995 A1 1/2008 Baun
2008/0052952 A1 3/2008 Nelson
2008/0072668 A1 3/2008 Miyagawa
2008/0078019 A1 4/2008 Allen, Jr. et al.
2008/0083786 A1 4/2008 Marin
2008/0098950 A1 5/2008 Gudjohnsen et al.
2008/0099088 A1 5/2008 Boey
2008/0109956 A1 5/2008 Bayley et al.
2008/0127410 A1 6/2008 Schmitt et al.
2008/0185396 A1 8/2008 Yang et al.
2008/0185398 A1 8/2008 Yang et al.
2008/0185399 A1 8/2008 Yang et al.
2008/0189850 A1 8/2008 Seggio et al.
2008/0193111 A1 8/2008 Seutter et al.
2008/0209760 A1 9/2008 French et al.
2008/0213644 A1 9/2008 Shindoh et al.
2008/0216343 A1 9/2008 Churchill et al.
2008/0216344 A1 9/2008 Churchill et al.
2008/0222910 A1 9/2008 Churchill et al.
2008/0253754 A1 10/2008 Rubin
2008/0256825 A1 10/2008 Hsu
2008/0271527 A1 11/2008 Hewitt
2008/0285134 A1 11/2008 Closset et al.
2008/0289098 A1 11/2008 Kunkel
2008/0301970 A1 12/2008 Hackwell et al.
2008/0313918 A1 12/2008 Dyson et al.
2008/0313919 A1 12/2008 Churchill et al.
2008/0317448 A1 12/2008 Brown et al.
2009/0000023 A1 1/2009 Wegelin et al.
2009/0000024 A1 1/2009 Louis et al.
2009/0000142 A1 1/2009 Churchill et al.
2009/0000147 A1 1/2009 Collins
2009/0031493 A1 2/2009 Tsujita et al.
2009/0034946 A1 2/2009 Simmonds
2009/0049599 A1 2/2009 Parsons et al.
2009/0056011 A1 3/2009 Wolf et al.
2009/0058666 A1 3/2009 Clabaugh
2009/0069870 A1 3/2009 Haase et al.

(56) References Cited

U.S. PATENT DOCUMENTS

| | | | | |
|---|---|---|---|---|
| 2009/0077736 | A1* | 3/2009 | Loberger | E03C 1/057 4/623 |
| 2009/0094740 | A1 | 4/2009 | Ji | |
| 2009/0100593 | A1 | 4/2009 | Lincoln et al. | |
| 2009/0113746 | A1 | 5/2009 | Churchill et al. | |
| 2009/0113748 | A1 | 5/2009 | Dyson et al. | |
| 2009/0119832 | A1 | 5/2009 | Conroy | |
| 2009/0119942 | A1 | 5/2009 | Aisenberg et al. | |
| 2009/0126103 | A1 | 5/2009 | Dietrich et al. | |
| 2009/0159612 | A1 | 6/2009 | Beavis et al. | |
| 2009/0236358 | A1 | 9/2009 | Rippl et al. | |
| 2009/0243243 | A1 | 10/2009 | Watson | |
| 2009/0266157 | A1 | 10/2009 | Maruo et al. | |
| 2009/0272445 | A1 | 11/2009 | Shimizu et al. | |
| 2009/0293190 | A1 | 12/2009 | Ringelstetter et al. | |
| 2009/0293192 | A1 | 12/2009 | Pons | |
| 2009/0293304 | A1 | 12/2009 | Yang | |
| 2010/0014844 | A1 | 1/2010 | Dannenberg et al. | |
| 2010/0132112 | A1 | 6/2010 | Bayley et al. | |
| 2010/0139394 | A1 | 6/2010 | Pauer et al. | |
| 2010/0154239 | A1 | 6/2010 | Hutchinson | |
| 2010/0168926 | A1 | 7/2010 | Bayley et al. | |
| 2010/0192399 | A1 | 8/2010 | Sawabe et al. | |
| 2010/0199759 | A1 | 8/2010 | Prasad | |
| 2010/0213208 | A1 | 8/2010 | Ben et al. | |
| 2010/0219013 | A1 | 9/2010 | Liddell | |
| 2010/0223993 | A1 | 9/2010 | Shimizu et al. | |
| 2010/0231392 | A1 | 9/2010 | Sherron | |
| 2010/0236092 | A1 | 9/2010 | Causier | |
| 2010/0252759 | A1 | 10/2010 | Guler et al. | |
| 2010/0269364 | A1 | 10/2010 | Liu | |
| 2010/0276529 | A1 | 11/2010 | Nguyen | |
| 2010/0296799 | A1 | 11/2010 | Liu | |
| 2011/0006083 | A1 | 1/2011 | Walters et al. | |
| 2011/0023319 | A1 | 2/2011 | Fukaya et al. | |
| 2011/0155934 | A1 | 6/2011 | Guler et al. | |
| 2011/0171083 | A1 | 7/2011 | Swistak | |
| 2011/0277342 | A1 | 11/2011 | Ishii et al. | |
| 2012/0011739 | A1 | 1/2012 | Nakamura | |
| 2012/0017459 | A1 | 1/2012 | Kikuchi et al. | |
| 2012/0017460 | A1 | 1/2012 | Kikuchi et al. | |
| 2012/0055557 | A1 | 3/2012 | Belz et al. | |
| 2012/0260418 | A1* | 10/2012 | Rundberg | E03C 1/057 4/623 |
| 2012/0285033 | A1 | 11/2012 | Hsu | |
| 2012/0291195 | A1 | 11/2012 | Courtney et al. | |
| 2012/0291303 | A1 | 11/2012 | Courtney et al. | |
| 2012/0318386 | A1 | 12/2012 | Guzman | |
| 2013/0025045 | A1 | 1/2013 | Gagnon et al. | |
| 2013/0031799 | A1 | 2/2013 | Gagnon et al. | |
| 2015/0052678 | A1* | 2/2015 | Bayley | A47K 10/48 4/638 |

FOREIGN PATENT DOCUMENTS

| | | | | |
|---|---|---|---|---|
| AU | 2006274708 | | 2/2007 | |
| AU | 2006274715 | | 2/2007 | |
| BE | 347407 | | 12/1927 | |
| CN | 102665512 | | 9/2012 | |
| DE | 504089 | | 7/1930 | |
| DE | 2018695 | | 10/1971 | |
| DE | 2304815 | | 8/1974 | |
| DE | 2657164 | | 12/1976 | |
| DE | 7707416 | | 7/1977 | |
| DE | 3036623 | | 2/1982 | |
| DE | 4218658 | | 12/1992 | |
| DE | 9304270 | | 9/1993 | |
| DE | 9304160 | | 7/1994 | |
| DE | 19608157 | | 7/1997 | |
| DE | 10210474 | | 9/2002 | |
| DE | 69821140 | | 11/2004 | |
| DE | 20-2004-012352 | | 12/2004 | |
| DE | 20-2005-018472 | | 2/2006 | |
| DE | 20-2007-014808 | | 4/2009 | |
| DE | 10-2009-003070 | | 11/2010 | |
| EP | 0274785 | | 7/1988 | |
| EP | 1057942 | | 12/2000 | |
| EP | 1241301 | | 9/2002 | |
| EP | 1250878 | | 10/2002 | |
| EP | 1258568 | | 11/2002 | |
| EP | 1057441 | | 9/2006 | |
| EP | 1912549 | | 3/2010 | |
| EP | 2177142 | | 4/2010 | |
| EP | 2277424 | | 1/2011 | |
| EP | 2554085 | | 2/2013 | |
| GB | 549766 | | 12/1942 | |
| GB | 737054 | | 9/1955 | |
| GB | 909069 | | 10/1962 | |
| GB | 915674 | | 1/1963 | |
| GB | 2249026 | | 4/1992 | |
| GB | 2358350 | | 7/2001 | |
| GB | 2380676 | | 4/2003 | |
| GB | 2450563 | | 12/2008 | |
| GB | 2467661 | A * | 8/2010 | E03C 1/01 |
| GB | 2467661 | B * | 2/2013 | E03C 1/01 |
| JP | 49-037655 | | 4/1974 | |
| JP | 61-179993 | | 11/1986 | |
| JP | 1-71575 | | 5/1989 | |
| JP | 1256632 | | 10/1989 | |
| JP | 3-125861 | | 12/1991 | |
| JP | 04-221523 | | 8/1992 | |
| JP | 04-136195 | | 12/1992 | |
| JP | 5-7752 | | 2/1993 | |
| JP | 5163748 | | 6/1993 | |
| JP | 05-055988 | | 7/1993 | |
| JP | 06-062977 | | 3/1994 | |
| JP | 07-116076 | | 5/1995 | |
| JP | 8-140891 | | 6/1996 | |
| JP | 08-164088 | | 6/1996 | |
| JP | 08-196470 | | 8/1996 | |
| JP | 08-266939 | | 10/1996 | |
| JP | 9-056640 | | 3/1997 | |
| JP | 9-098907 | | 4/1997 | |
| JP | 9-135788 | | 5/1997 | |
| JP | 09-215631 | | 8/1997 | |
| JP | 9242155 | | 9/1997 | |
| JP | 10-113304 | | 5/1998 | |
| JP | 10-113305 | | 5/1998 | |
| JP | 10-248748 | | 9/1998 | |
| JP | 10-257992 | | 9/1998 | |
| JP | 11-000283 | | 1/1999 | |
| JP | 11-113789 | | 4/1999 | |
| JP | 11-169317 | | 6/1999 | |
| JP | 11-244190 | | 9/1999 | |
| JP | 2000-000178 | | 1/2000 | |
| JP | 2000-000180 | | 1/2000 | |
| JP | 2000-157448 | | 6/2000 | |
| JP | 2000-184987 | | 7/2000 | |
| JP | 2000262433 | A | 9/2000 | |
| JP | 2000-271039 | | 10/2000 | |
| JP | 2000-282528 | | 10/2000 | |
| JP | 2000-300461 | | 10/2000 | |
| JP | 2001-000361 | | 1/2001 | |
| JP | 2001-003407 | | 1/2001 | |
| JP | 2001-104213 | | 4/2001 | |
| JP | 2001-140305 | | 5/2001 | |
| JP | 2001-346715 | | 12/2001 | |
| JP | 2002-028100 | | 1/2002 | |
| JP | 2002115303 | A | 4/2002 | |
| JP | 2002-136448 | | 5/2002 | |
| JP | 2002-345682 | | 12/2002 | |
| JP | 2003-153823 | | 5/2003 | |
| JP | 2003275112 | A | 9/2003 | |
| JP | 2004-215879 | | 8/2004 | |
| JP | 2004-281510 | | 9/2004 | |
| JP | 2005-168799 | | 6/2005 | |
| JP | 2006-081925 | | 3/2006 | |
| JP | 2006-101987 | | 4/2006 | |
| JP | 2006-192250 | | 7/2006 | |
| JP | 2006-204738 | | 8/2006 | |
| JP | 2006-304926 | | 11/2006 | |
| JP | 2007-054670 | | 3/2007 | |
| JP | 2007-082904 | | 4/2007 | |
| JP | 2007-098106 | | 4/2007 | |

(56) References Cited

FOREIGN PATENT DOCUMENTS

| | | | | |
|---|---|---|---|---|
| JP | 2007143584 | | 6/2007 | |
| JP | 2007209459 | A | 8/2007 | |
| JP | 2008-005883 | | 1/2008 | |
| JP | 2008-073152 | A | 3/2008 | |
| JP | 2008-080100 | | 4/2008 | |
| JP | 2008-099797 | | 5/2008 | |
| JP | 2008-110240 | | 5/2008 | |
| JP | 2008-272251 | | 11/2008 | |
| JP | 2009088657 | A | 4/2009 | |
| JP | 2010-046238 | | 3/2010 | |
| JP | 2010-075602 | | 4/2010 | |
| JP | 2010-110450 | | 5/2010 | |
| JP | 3-160341 | | 6/2010 | |
| JP | 2011019606 | A | 2/2011 | |
| JP | 2011-055859 | | 3/2011 | |
| KR | 100711544 | | 4/2007 | |
| NL | 1017777 | | 10/2002 | |
| TW | 567822 | | 12/2003 | |
| TW | 408638 | | 8/2011 | |
| WO | 96/26795 | | 9/1996 | |
| WO | 01/16436 | | 3/2001 | |
| WO | 03106772 | A1 | 12/2003 | |
| WO | 2006/055681 | | 5/2006 | |
| WO | 2007/011747 | | 1/2007 | |
| WO | 2007/015036 | | 2/2007 | |
| WO | 2007/015039 | | 2/2007 | |
| WO | 2007/015046 | | 2/2007 | |
| WO | 2007067924 | A2 | 6/2007 | |
| WO | 2009/011198 | | 1/2009 | |
| WO | 2009/039290 | | 3/2009 | |
| WO | WO 2009039290 | A2 * | 3/2009 | ..... E03C 1/01 |
| WO | 2009/062546 | | 5/2009 | |
| WO | WO 2009039290 | A3 * | 8/2009 | ..... E03C 1/01 |
| WO | 2010/088975 | | 8/2010 | |
| WO | 2010/089927 | | 8/2010 | |
| WO | 2010/095250 | | 8/2010 | |
| WO | 2010/095251 | | 8/2010 | |
| WO | 2010/119536 | | 10/2010 | |
| WO | 2011/009156 | | 1/2011 | |
| WO | 2011/044247 | | 4/2011 | |
| WO | 2011/074018 | | 6/2011 | |
| WO | 2011/077625 | | 6/2011 | |

* cited by examiner

LAVATORY WITH DUAL PLENUM HAND DRYER

CROSS-REFERENCE TO RELATED APPLICATION

The present application claims priority to and is a national stage entry of PCT/US12/58678 filed on Oct. 4, 2012, the disclosure of which is incorporated herein.

BACKGROUND OF THE INVENTION

The present invention relates generally to the field of lavatory systems and, more particularly, to touch-free hand dryers that use proximity sensors to commence the blowing of air.

In an effort to reduce the waste and frequently the mess associated with paper toweling in public washrooms such as those found in high traffic areas like schools, libraries, airports, train and bus terminals, shopping centers, theaters, and sports venues, wall-mounted electric hand dryers have become prevalent. More recently, proximity sensors have allowed for touch-free hand dryers that can be activated automatically when a user places his hands in a drying zone adjacent the hand dryer; typically, below and/or in front of the hand dryer. For many installations, the hand dryer is mounted on a wall opposite the wash basin and, quite frequently, one or two hand dryers will be provided for a bank (more than two) of wash basins. As a result, a user after cleaning his hands must walk some distance to the hand dryer. This frequently results in water and/or soap dripping onto the floor as the user walks from the wash basin to the hand dryer. As there are typically more wash basins than hand dryers, it is possible that water could pool on the floor during high use periods. The accumulated water can create a slippery and, consequently, potentially unsafe condition. Additionally, the hand dryer can blow water from the user's hands onto the floor during the drying process further adding to the amount of water that accumulates on the floor. Moreover, water and/or soap can accumulate on the countertop supporting the wash basin which can be unsightly, if not quickly addressed. Additionally, the accumulation of water and/or soap on the floor and/or countertop may lead to germ-infested areas thus posing additional health risks as well as creating discomfort for users that are particularly germ sensitive.

One proposed solution is described in U.S. patent application Ser. No. 12/233,466, which is assigned to Bradley Fixtures Corporation, the assignee of this application and which is incorporated herein by reference. The aforementioned application describes a lavatory system in which a hand-washing station has a wash basin, a faucet, and an electric hand dryer. The integration of these components into a single wash station alleviates the need for a user to leave the wash station to access a hand dryer. That is, the hand dryer is adjacent the wash basin and (heated) air is blown into an area generally above the wash basin. Accordingly, a user can water and soap his hands in a conventional manner and then move his hands to the drying zone of the hand dryer. The user's hands do not need to leave the wash basin for the hands to be exposed to the drying air. Hence, water does not drip onto the floor as the user presents his hands to the dryer and water removed from the hands is blown into the wash basin rather than onto the floor.

The lavatory system described in the aforementioned application provides a significant improvement over conventional lavatory systems. However, the present inventor has discovered that many users of such an integrated wash station do not slide their hands over from below the faucet to the drying zone of the hand dryer. The inventor has found that some users, so conditioned to extract their hands from the wash basin entirely, will remove their hands from the wash basin and then present their hands to the front of the drying zone. As the hand dryer is activated when one or more proximity sensors sense the presence of the user's hands, it has been found that such a front-presentment can result in splashback of water onto the clothes of the user, the floor, or the countertop.

SUMMARY OF THE INVENTION

A lavatory system may include a faucet extending from the lavatory system configured to dispense water. To facilitate hand washing, a soap dispenser may be attached to the lavatory system configured to dispense a liquid soap. Following hand washing, a hand dryer may be attached to the lavatory proximate the soap dispenser and including a first plenum outlet extending from a rear portion of the lavatory at a first height.

A basin may be attached to the lavatory system, configured to collect the water and the soap dispensed from the faucet and the soap dispenser. The basin may further include a second plenum outlet incorporated in the basin at a second height lower than the first height, wherein the first plenum outlet and the second plenum outlet deliver a pressurized air to dry a user's hands.

A display may also be incorporated in a portion of the lavatory system configured to display graphic or textual information to a user. a touch-sensitive sensor incorporated in the display configured to receive a manual input including operational parameters for the lavatory system including at least one of a motor run time, a faucet run time, and a volume of soap dispensed per cycle.

To promote further sanitation, a sterilization feature may be attached to the lavatory system including ultraviolet light configured to sterilize at least one of the basin, the pressurized air, and the user's hands. the sterilization features include a separate ultra violet chamber incorporating at least a portion of the basin configured to accept the user's hands.

A noise cancellation system may also be included within the lavatory system configured to mitigate a sound of the operation of the hand dryer. The noise cancellation system may include at least one of a mechanical noise cancellation device and an electrical noise cancellation device. A sound amplifier may be connected to the noise cancellation system configured to provide noise cancellation. A sound-absorbing material may also be attached to the lavatory configured to provide mechanical noise cancellation.

In order to monitor and maintain the lavatory, a system diagnostics system may be included within the lavatory system and also have an integrated diagnostic data collection system programmed to collect and display a diagnostic data on the display including at least one of a hand dryer motor run time, a soap level, a period between a motor use cycles, a hand dryer air filter status, and an amount of water dispensed from the faucet. A communication system may be used and configured to transmit the diagnostic data, in communication with a remote facility allowing a technician to remotely monitor the system diagnostics system.

For international use, a power circuit may be included within the lavatory system configured to adapt to a plurality of different voltage inputs from a plurality of different countries and modify the voltage input to match a voltage requirement of a blower motor for the hand dryer and other electrical apparatuses.

In order to more effectively direct the blown air, a plurality of nozzles may be used extending from the upper plenum outlet and the lower plenum outlet, wherein the nozzles include a non-uniform shape and a non-uniform size and wherein the nozzles are oriented in a plurality of angles.

A moisture detector may also be used proximate the hand dryer configured to measures a moisture level of the user's hands and determine a run time of the hand dryer.

The basin may also include a first drain in the basin below the faucet and a second drain in the basin below the upper plenum outlet.

In order to conserve energy, an electrical energy generator may be included within the lavatory system configured to convert a kinetic energy from the pressurized air of the upper plenum outlet and the lower plenum outlet into an electrical energy.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF PREFERRED EMBODIMENTS

Figure 1:
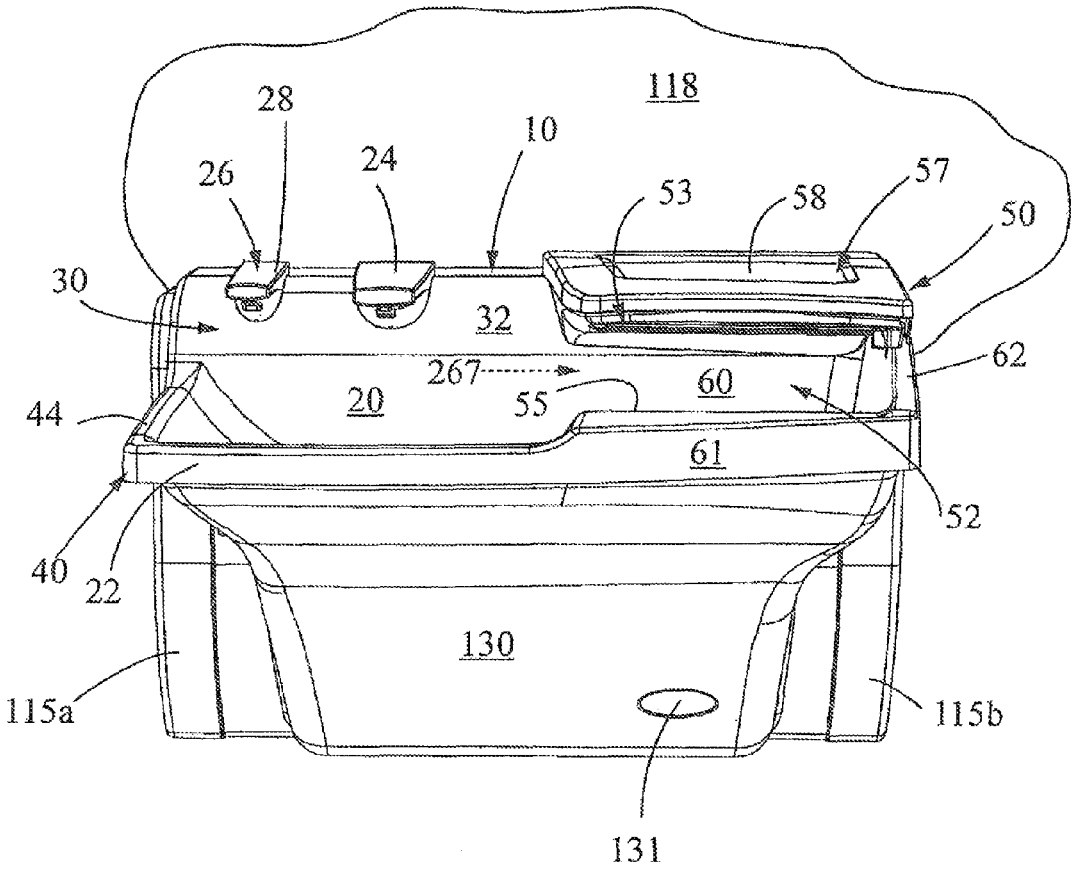
FIG. 1 illustrates a front view of a lavatory system of the present invention.

The present invention will be described with respect to a hand dryer that is part of an integrated lavatory system also having a wash basin, a water faucet, and, optionally, a soap dispenser. However, it is understood that the present invention is applicable with stand-alone hand dryers, such as conventional wall-mounted hand dryers, and may also be desirable for other types of dryers in which it is desirable to delay commencement of a drying cycle based on the presentment of an object for drying to a drying chamber, cavity, or zone. In one preferred embodiment, the present invention is applicable with an integrated lavatory system such as those described in U.S. patent application Ser. Nos. 12/233,466 and 13/122,368 and herein incorporated by reference; however, as noted above, the invention is not so limited.

Turning now to FIGS. 1-24, a lavatory system 10, preferably, has a wash basin 20, including a wash basin wall 22.

As shown in FIGS. 1-4, faucet 24 is provided within the wash basin 20. The faucet 24 may include indicia etched thereon such as a water droplet symbol or a faucet light 23 for directing a user. Such indicia may be particularly helpful to a user that has poor eyesight. The faucet 24 may also include a sensor located behind a sensor window 25 which automatically engages a faucet control to provide water to the user. The faucet 24 is connected to plumbing to provide hot and/or cold water to the faucet. Preferably, the water is provided at a comfortable temperature for the user's hands.

A soap dispensing system 26 is near the faucet 24 and in the wash basin 20. The soap dispenser 26 includes a spout 28 and a soap-dispensing sensor (located behind sensor window 29) to detect an object, such as a user's hand 166 (See, e.g., FIG. 20), and to provide soap thereto. Indicia, such as soap bubbles, or a light 27 may also be provided on the spout 28. As best shown in FIG. 1, a countertop 30 is preferably provided above and around the wash basin 20. The soap dispenser or system 26 includes a liquid soap container (not shown) located under the wash basin 20 and countertop 30 and that is connected to the spout 28. A backsplash 32 may also be present and integral with the countertop 30. Thus, the soap container is masked, in part, also by the backsplash 32. Further disclosure of embodiments of the soap dispensing system 26 may be found in co-pending U.S. patent application Ser. Nos. 12/233,466 and 13/088,512 further incorporated herein by reference.

Figure 2:
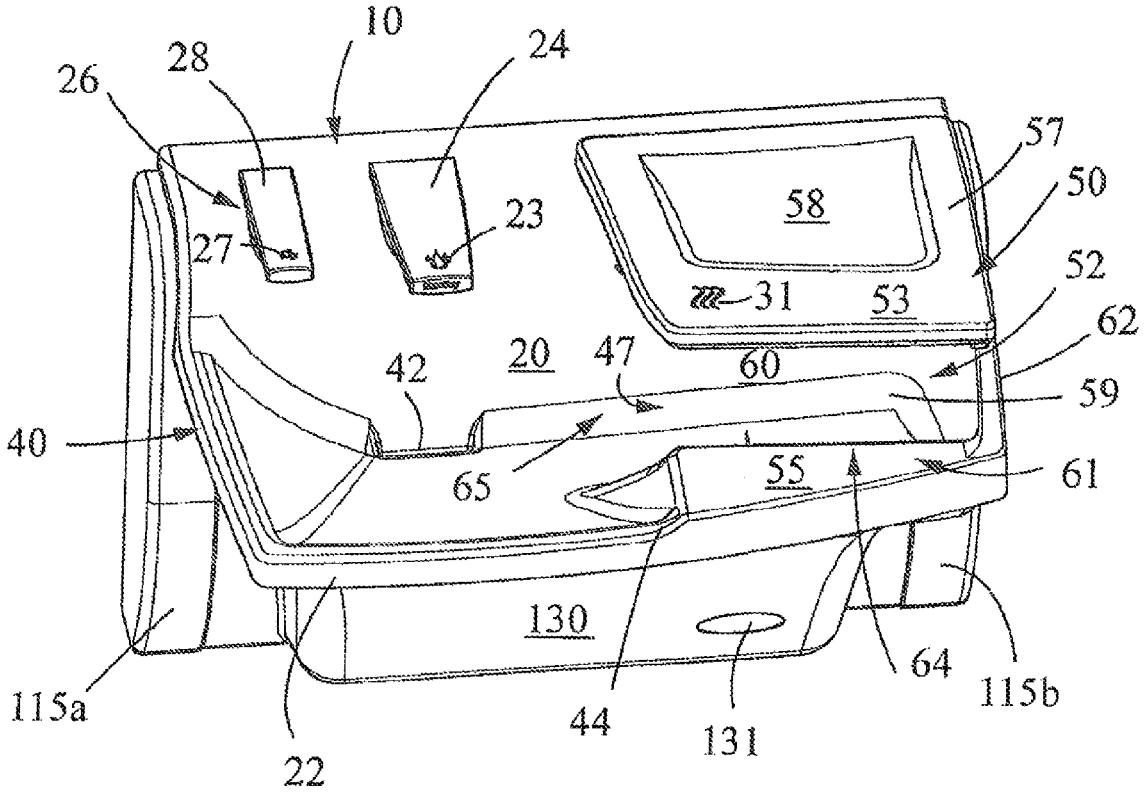
FIG. 2 is a front elevation view of a lavatory system according to the present invention.
Figure 3:
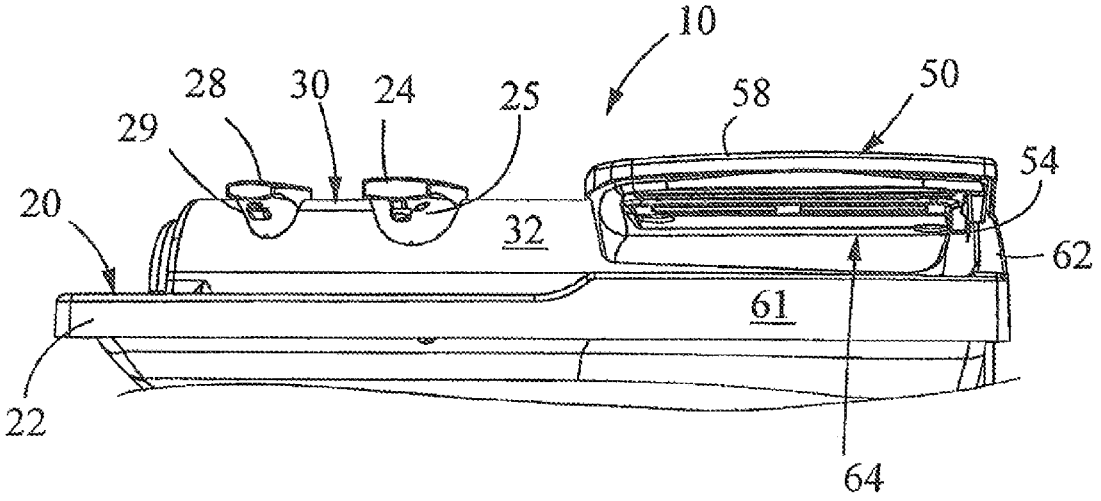
FIG. 3 is a front elevation cutaway view of a lavatory system according to the present invention showing upper portion and hand-washing features.
Figure 4:
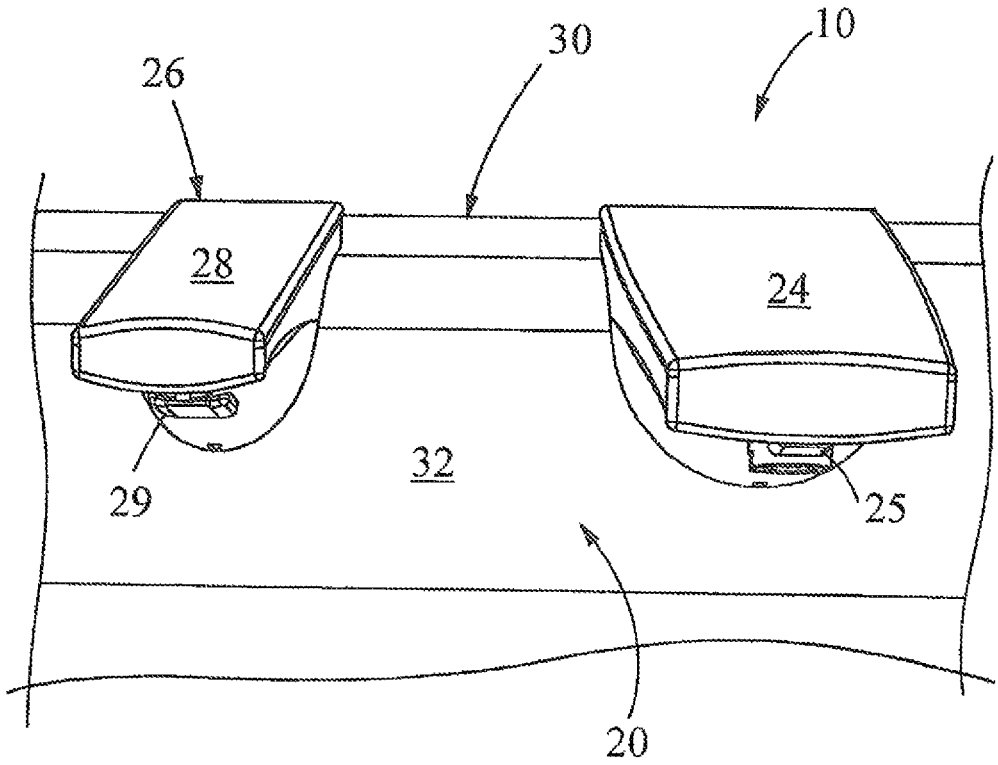
FIG. 4 is a front elevation view of a cutaway portion of the lavatory system according to the present invention showing the faucet and soap dispenser.

As best seen in FIG. 2, preferably a single drain 42, preferably with drain cap, is provided in the wash basin 20. This drain 42 takes soap and water from the wash basin 20 down to a drainpipe (not shown). The drainpipe 127 is preferably located directly under the wash basin 20 (see, e.g., FIG. 18).

As seen in FIGS. 5-9, the lavatory system 10 preferably includes an integral drying system, e.g., a hand dryer 50. The dryer 50 has a hand-receiving cavity 52 and a motor 74. In one preferred embodiment, a mechanism 40 for preventing flooding and damage to the motor 74 is provided. The mechanism 40 may include a flood relief rim or overflow lip 44 located on the wash basin 20, see, e.g., FIG. 6A. The flood relief rim 44 is provided below the lower portion's air outlet 56 and the nozzle tips 162*b* as shown. Thus, water that cannot make it down the drain 42 will flow over the flood relief rim 44 and not down the nozzle holes 162*b* and into the motor 74. Other motor protection and flood prevention mechanisms 40 will be described further below.

Referring now to FIG. 2, the hand dryer 50 may be provided with etched instructional indicia, a heat wave symbol, or light 31. A drain conduit 47 is preferably present to fluidly connect the hand-receiving cavity 52 and wash basin 20. The conduit 47 removes excess water left from the user's hands through the hand-receiving cavity 52 down toward the single drain 42 in the wash basin 20. This water then travels down the drainpipe 127, see, e.g., FIG. 18.

Figure 5:
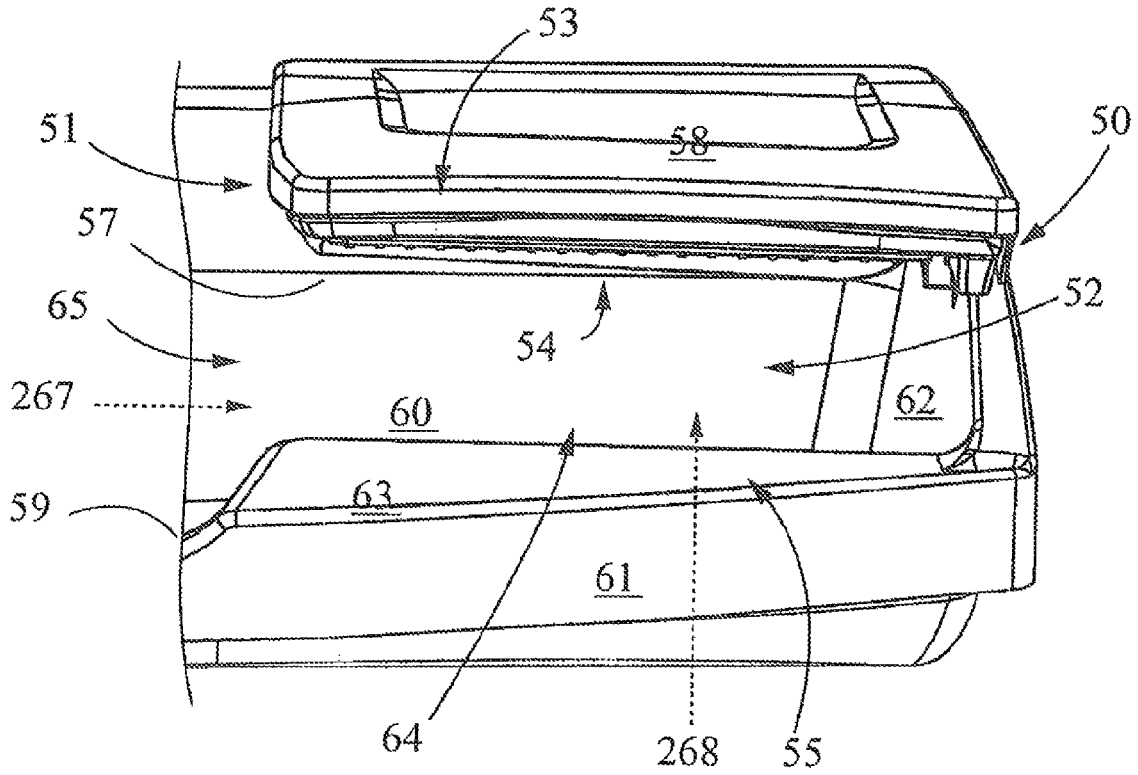
FIG. 5 is a front elevation view of a cutaway portion of the lavatory system according to the present invention showing the upper portion and upper air outlet.

As best seen in FIG. 5, the hand dryer 50 is preferably provided with a top portion 53 and a bottom portion 55. The top portion 53 may also include a hood 51 with a base which forms a top wall 57 of the cavity 52. The top portion hood 51 may also include a top portion cover which may form a shelf 58. An upper air outlet 54 is also provided in the upper portion 53.

Figure 6A:
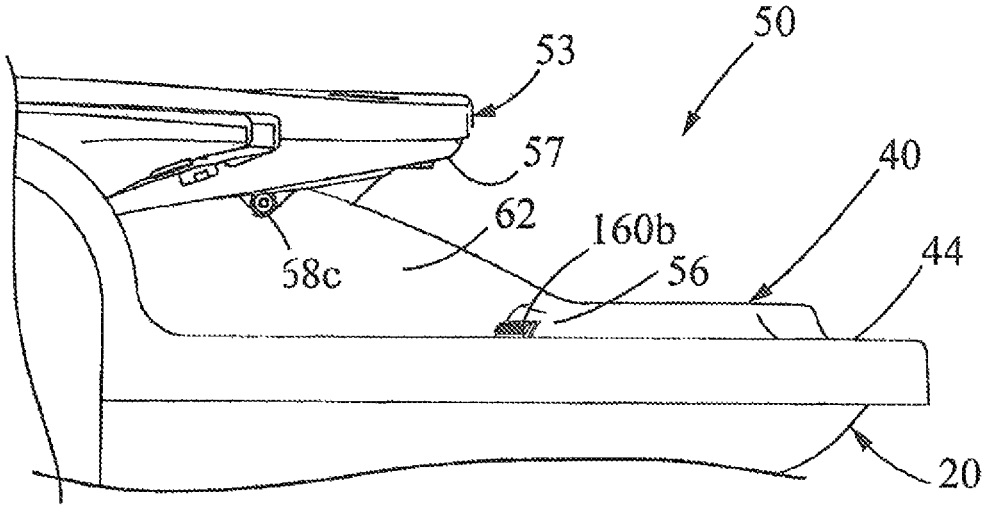
FIG. 6A is a side view of a cutaway portion of the lavatory system according to the present invention showing the upper portion, lower nozzles, and basin.
Figure 6B:
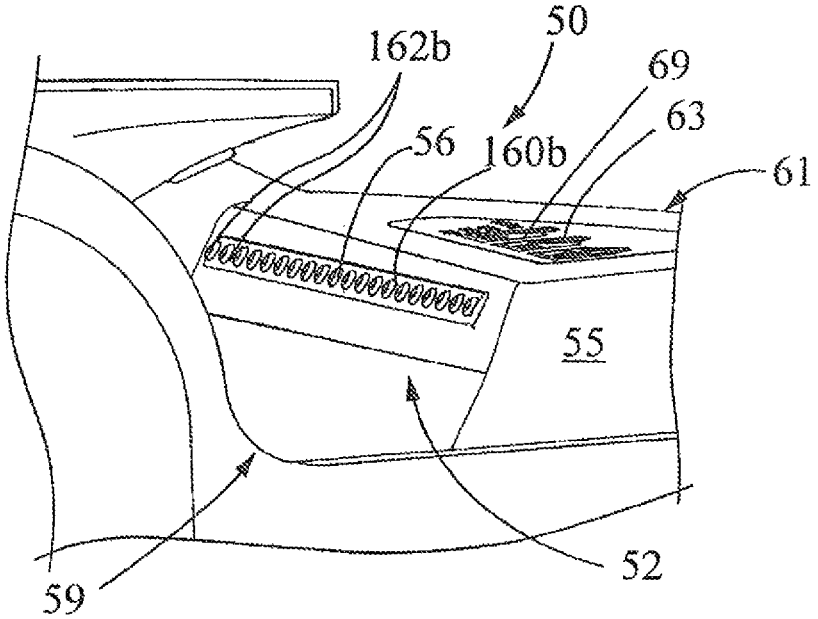
FIG. 6B is a side view of a cutaway portion of the lavatory system according to the present invention illustrating the hand dryer and lower nozzle tips.

As best shown in FIGS. 5, 6A, and 6B, a bottom portion 55 includes a lower air outlet 56. The bottom portion 55 is formed, in part, by bottom wall 59. The bottom portion 55 of the hand-receiving cavity 52 preferably also includes a back wall 60, front wall 61, and single side wall 62 (see, e.g., FIG. 5). A front ledge 63 is preferably integral with the front wall 61. The hand-receiving cavity 52, therefore, is preferably configured to have a front opening 64 and a single side opening 65 (herein the left side) and to allow users to enter their hands at a generally oblique angle. Further, instructions 69 for using the hand dryer may provided on the front ledge 63 as shown in FIG. 6B.

Figure 7:
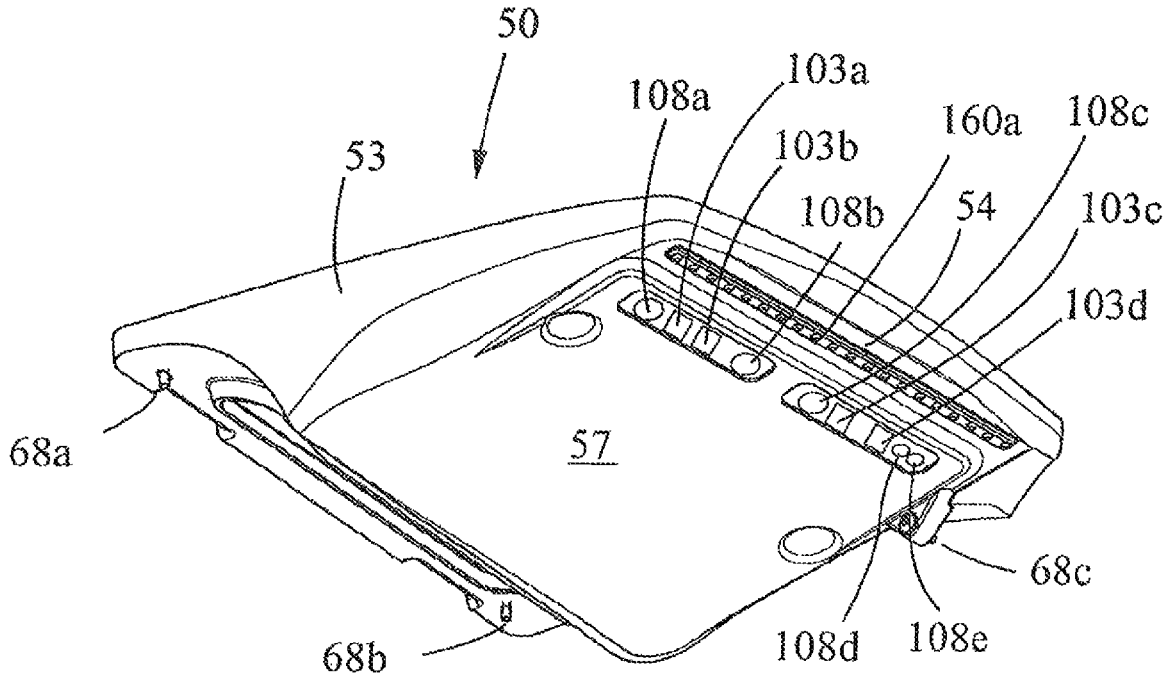
FIG. 7 is a partially exploded lower view of the hand dryer showing the top portion, upper air outlet, and hand dryer sensors.

As best shown in FIG. 7, one embodiment includes a top wall or base 57 that attaches to the backsplash 32 (not shown) and countertop 30 (not shown) preferably with bolts 68*a* and 68*b*. A side anchoring screw 68*c* is also provided to attach the top portion 53 to side wall 62 (see, e.g., FIG. 9). The top portion 53 preferably also has multiple sensors 103*a-d* and LED lights, e.g., 108*a-e* located therein and preferably covered by a window to protect them from splashing water and debris.

Figure 8:
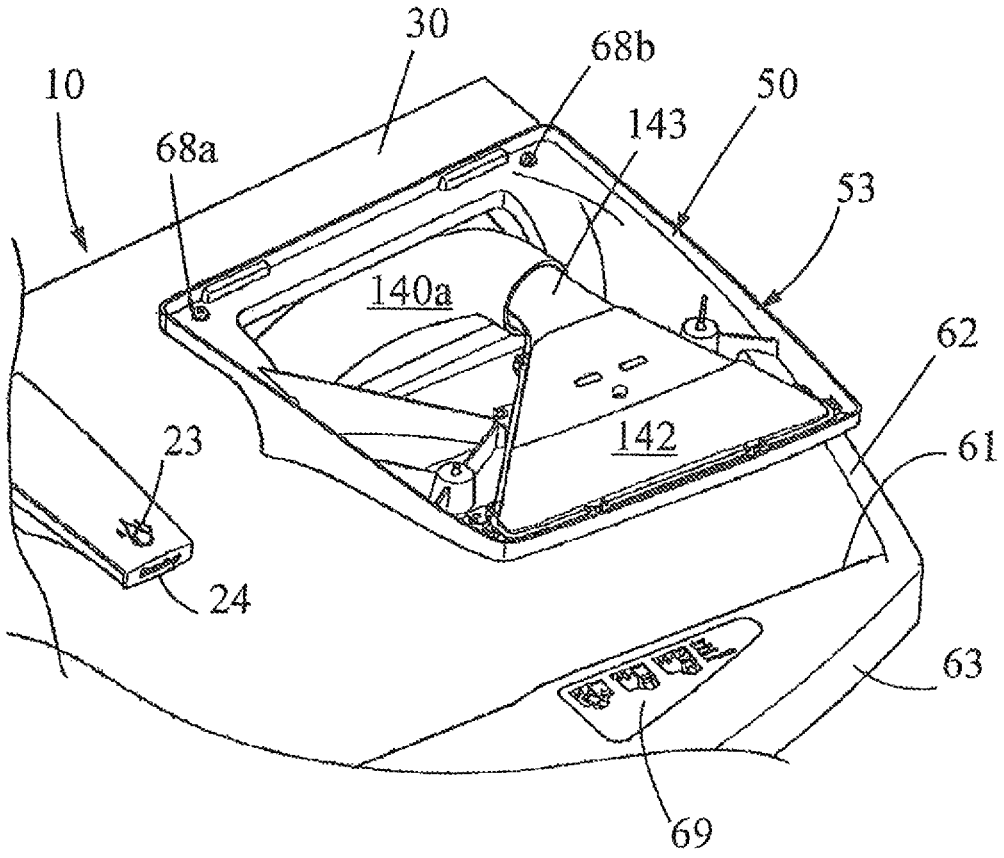
FIG. 8 is a partially exploded upper view of the top portion showing the upper plenum.

FIG. 8 shows the top portion 53 of the hand dryer 50 with the top cover 58 removed. Inside the top portion 53 is a hose 140*a* which attaches to a first or upper plenum 142. The hose 140*a* is connected to the first or upper plenum air inlet 143 (see, e.g., FIG. 11) to provide air to the upper plenum 142.

Figure 9:
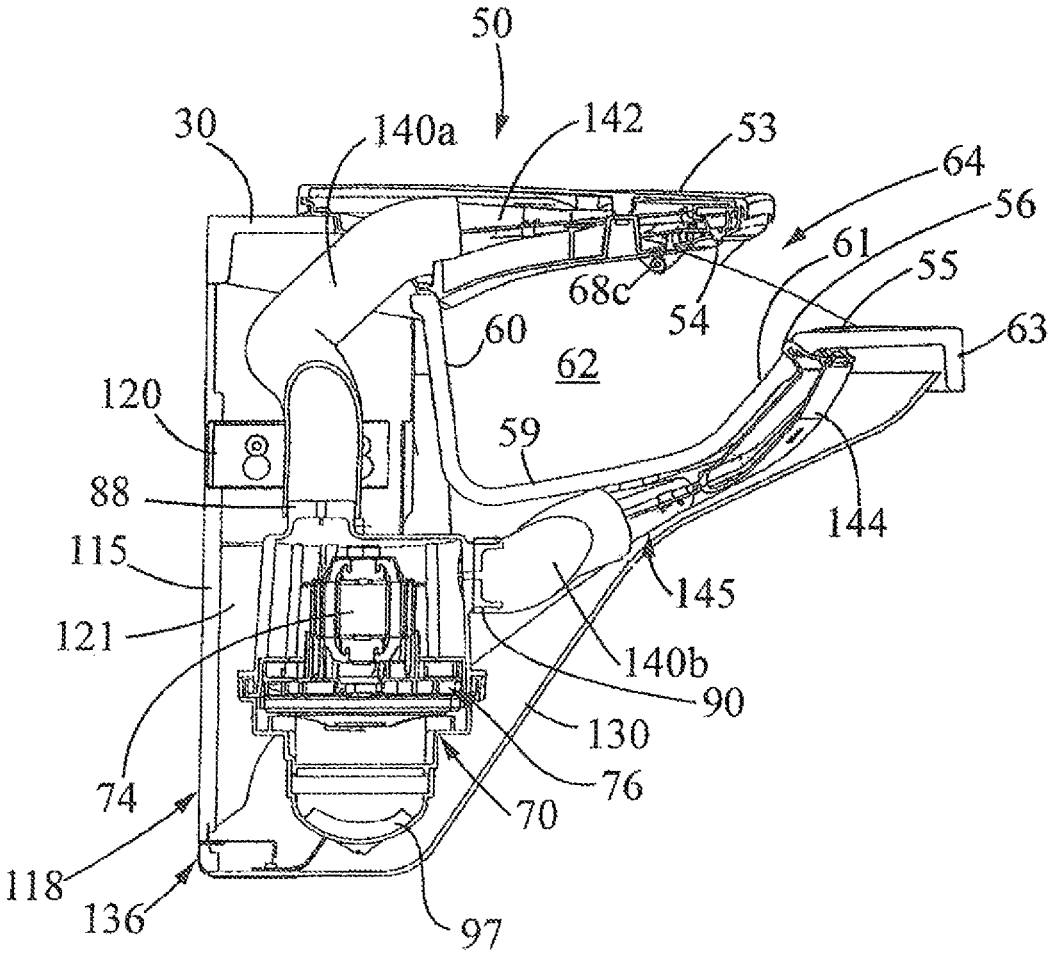
FIG. 9 is a side cross-sectional view of the lavatory system showing the hand dryer, motor, upper plenum, and lower plenum.
Figure 10:
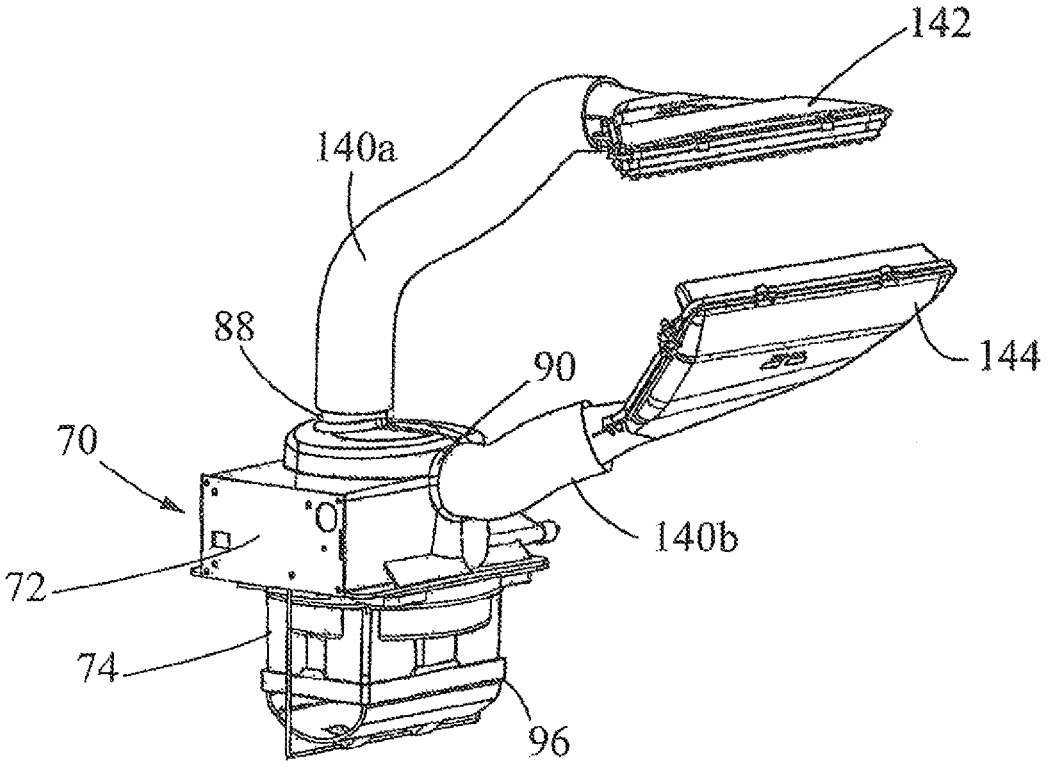
FIG. 10 is a view of the lavatory system showing the hand dryer motor, upper plenum, and lower plenum.

As shown in FIGS. 9 and 10, a second, or lower plenum 144, is also provided. The lower plenum 144 is connected to a hose 140*b* which delivers air to the lower plenum 144 via a lower plenum air inlet 145. The preferably flexible hoses 140*a* and 140*b* are attached to a first outlet port 88 and a second outlet port 90 which are preferably on or part of a motor housing 70. A blower 71 including a motor 74 with a fan 76 (see, e.g. FIGS. 15 and 16), provides air to the hand dryer 50. The air outlets 54, 56 are configured in such a way so that they provide air into the hand-receiving cavity 52 (see, e.g., FIGS. 5 and 6B) downwardly and back toward the back wall 60. For example, in one embodiment, the two outlet or exhaust ports 54, 56 are offset from one another in horizontal planes, i.e., the lower plenum 144 nozzle holes 164*b* are at about a 37 degree angle from horizontal and located closer to the user than the upper plenum 142 nozzle holes 164*a* which are at about an angle of 1 degree rearward from vertical and located closer to the backsplash 32 of the hand dryer cavity 52. This configuration prevents water from splashing onto the user once it is removed from the user's hands. FIG. 10 shows the motor 74 and motor housing 70 operably connected to plenums 142, 144. As shown, the motor housing 70 preferably has an aluminum cover plate 72 and an intake cover 96.

Figure 11:
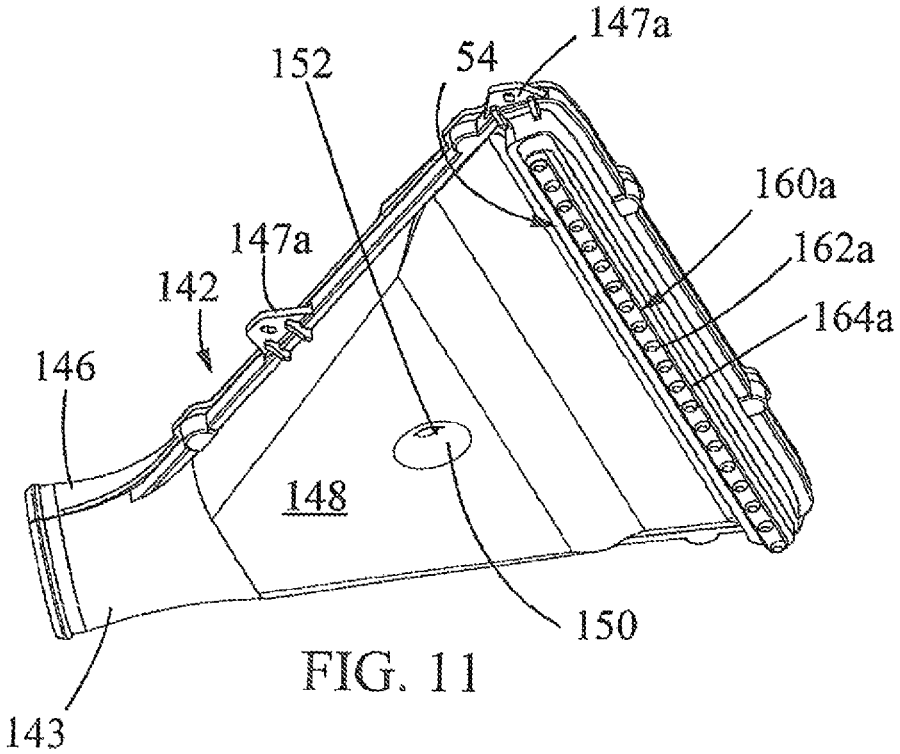
FIG. 11 is a lower view of the hand dryer upper plenum of the lavatory system according to the present invention.
Figure 12:
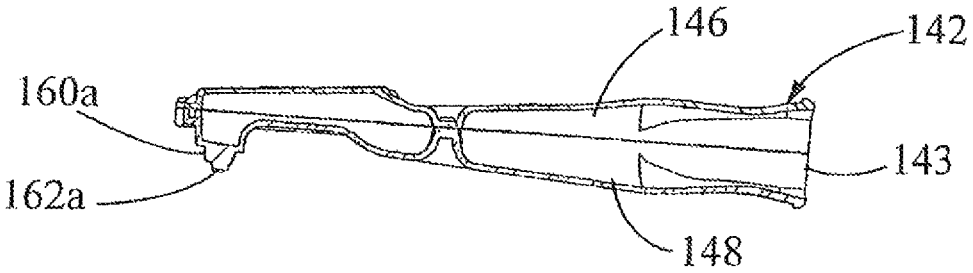
FIG. 12 is a side cross-sectional view of the hand dryer upper plenum of the lavatory system according to the present invention.

FIGS. 11 and 12 show the upper plenum 142 in detail. The upper plenum 142, preferably, is constructed of top piece 146 and a bottom piece 148. The upper plenum air inlet 143 is preferably integral with the upper plenum's 142 top piece 146 and bottom piece 148. A center post 150 and a screw 152 may be used to connect the top piece 146 to the bottom piece 148. Plastic bonding techniques, such as adhesives, may also be used. Additional screws and posts may also be provided along the outside of the plenum 142. The plenum 142 preferably has top nozzles 160*a* molded into it to provide the top portion upper air outlet 54. The top nozzles 160*a* preferably include pointed or frustoconical nozzle tips 162*a* that have nozzle holes 164*a* therethrough. The upper plenum 142 has multiple projections or tabs 147*a* protruding therefrom. The projections 147*a* act as connecting points for screws to attach the plenum to the lavatory system 10.

Figure 13:
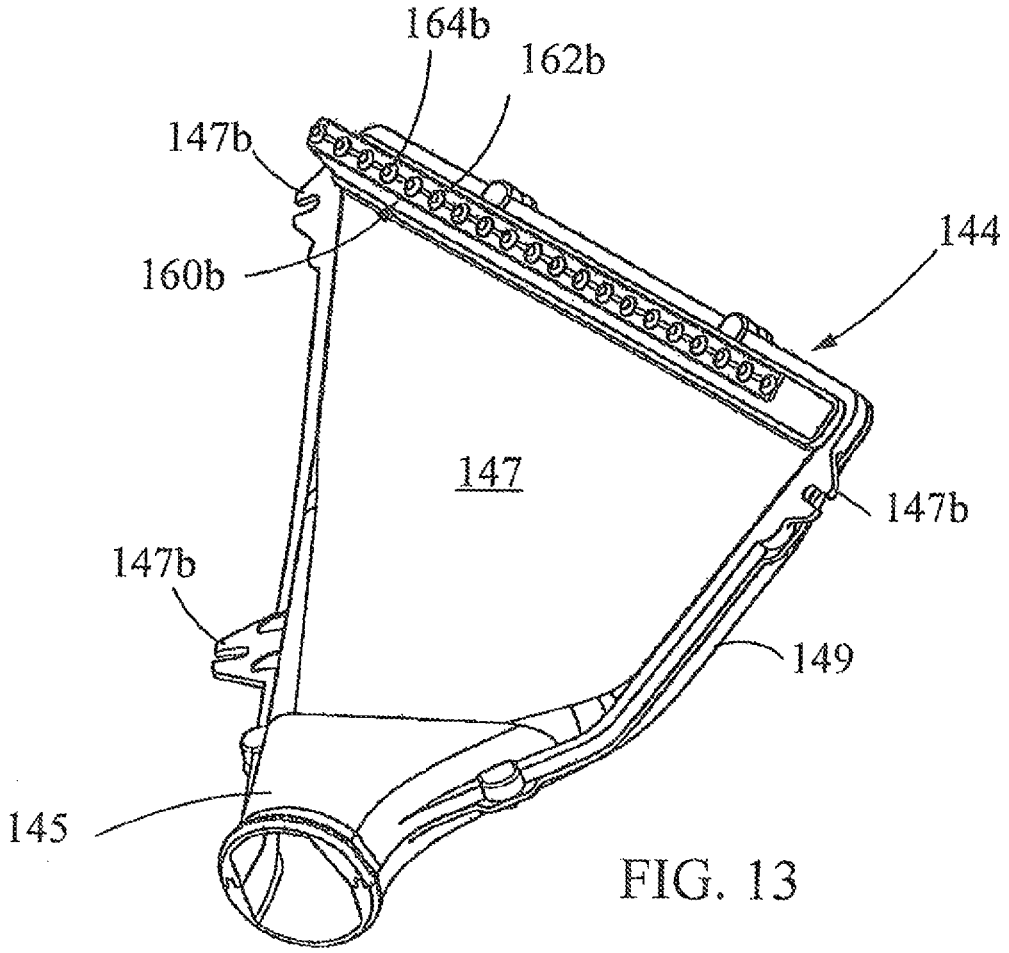
FIG. 13 is a view of the hand dryer lower plenum of the lavatory system according to the present invention.
Figure 14:
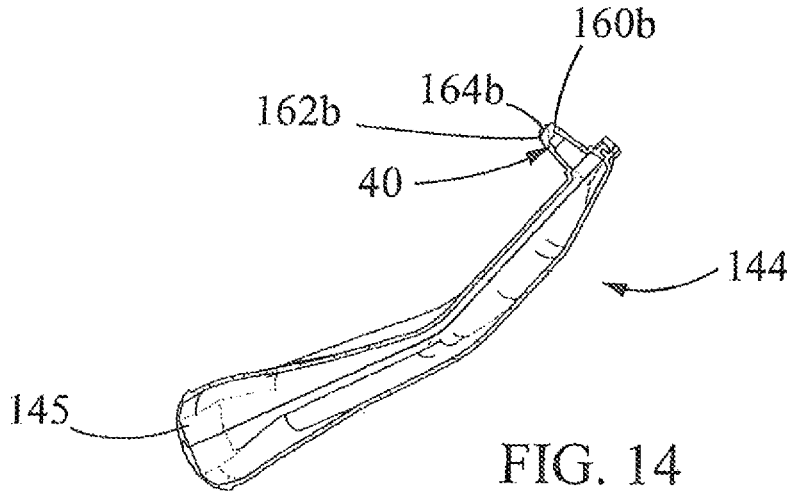
FIG. 14 is a side view of the hand dryer lower plenum of the lavatory system according to the present invention.

As shown in FIGS. 13 and 14, the lower plenum 144 is similarly configured. The lower plenum 144 has a top piece 147 connected to a bottom piece 149, preferably, by bonding and/or posts and screws. A lower plenum air inlet 145 is also provided. The lower plenum air inlet 145 is preferably integral with the rest of the lower plenum 144. The lower plenum 144 also has multiple projections or tabs 147*b* protruding therefrom which act as connecting points for screws to attach the plenum 144 to the lavatory system 10. The upper plenum 142 and the lower plenum 144 are preferably each constructed of two injection-molded plastic top and bottom pieces bonded and/or screwed together. Each plenum may also contain a center post screw (not shown) to minimize deflection of the plenum when pressurized.

Bottom nozzles 160*b* are provided, again, preferably by molding into the lower plenum 144. Lower nozzles 160*b*, like the upper nozzles 160*a*, preferably have protruding frustoconical nozzle tips 162*b* each of which has a nozzle hole 164*b* therethrough. The shape of the nozzle tips 162*b* on the lower plenum 144 further acts as a flood prevention mechanism 40 to protect the motor 74.

Figure 15:
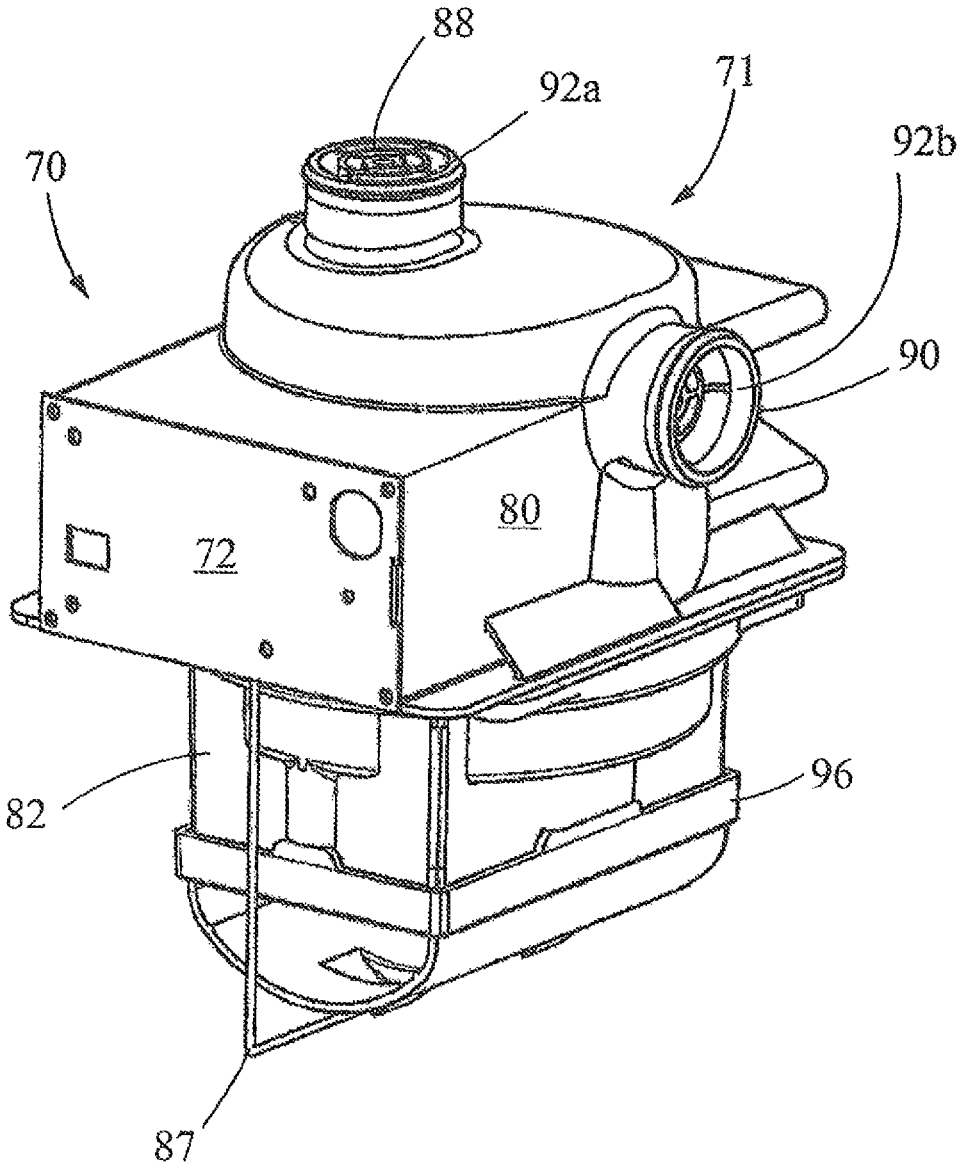
FIG. 15 is a view of the hand dryer motor of the lavatory system according to the present invention.
Figure 16:
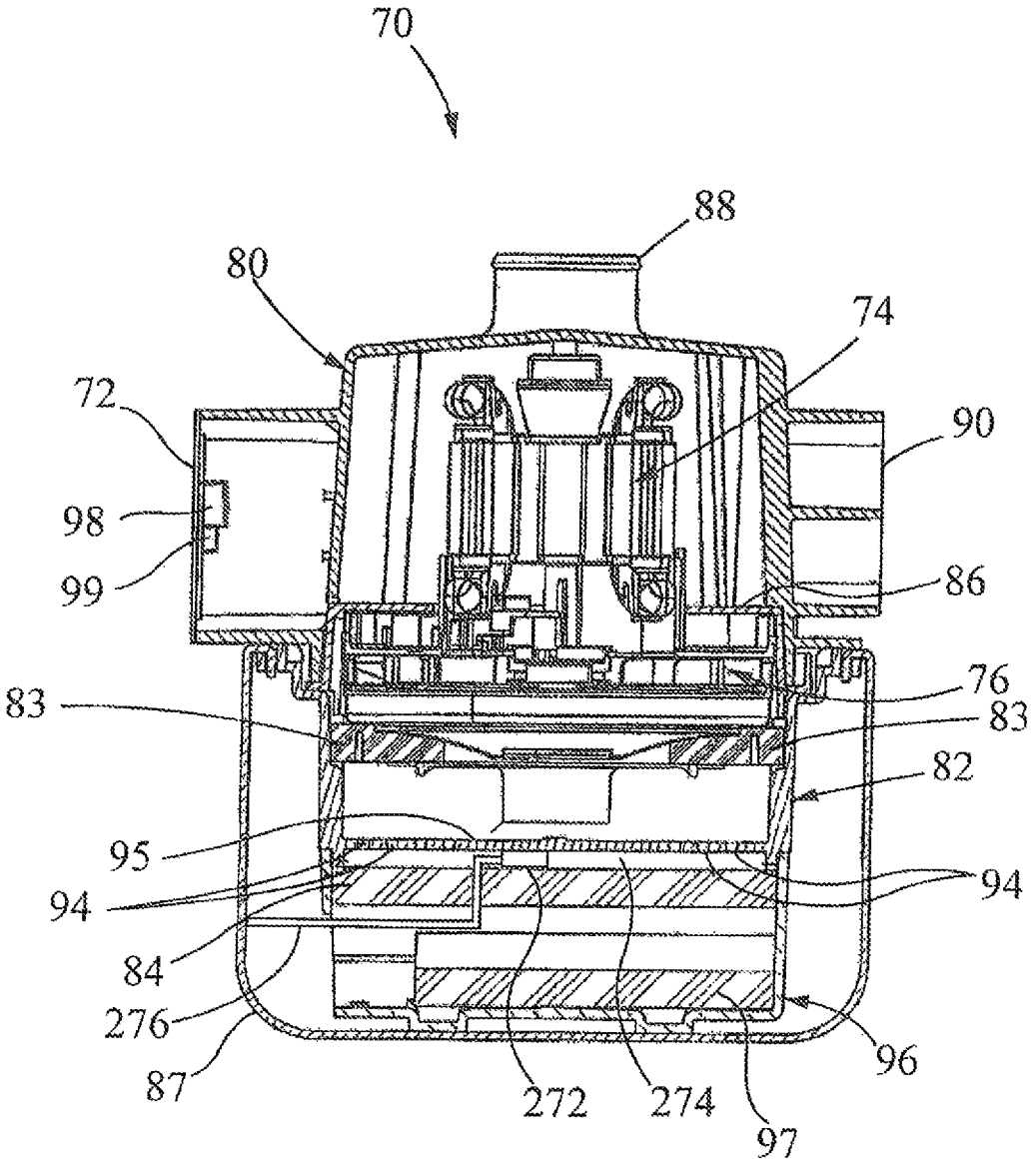
FIG. 16 is a side cross-sectional view of the hand dryer motor of the lavatory system according to the present invention.

The hand-dryer blower 71, motor 74, and motor housing 70 are best shown in FIGS. 15 and 16. Motor housing 70 includes an aluminum cover plate 72 and an upper or outer casement 80. An intake air manifold cap or housing cap 82 is provided toward a lower end of the motor housing 70. The motor 74 is inside the motor housing 70 and has a fan 76 with blades (not shown) to blow air. Preferably, a rubber motor mounting ring and/or housing isolation gasket 86 is also provided. This gasket 86 helps reduce vibrations and deaden the motor's sound. A filter 84 is preferably provided within the housing 70 to filter the intake air. The filter 84 is preferably constructed of HEPA media or some other suitable media. Also contained within the motor housing 70 is acoustic insulation foam 83 to further isolate and lessen motor noise. The motor may be electronically commutated to eliminate the exhaust of worn carbon through the air passages of the hand dryer system and toward the hand dryer user's hands.

The intake air portion or lower portion of the motor housing cap 82 is configured with a solid center section 95 surrounded by a circular pattern of holes 94. This configuration is spaced at a distance similar to the half wave length of the fan blade passing frequency of the fan motor 74. As a result, acoustical waves are reflected off of the solid center section 95 on the bottom of the housing cap 82 at a fan cowling and the acoustical foam 83, and eventually propagate through the circular hole pattern 94 in an attenuated manner.

A filter or intake cover 96 may also be provided in the housing 70 to contain or to hold the filter 84 in place. To further attenuate sound generated by the fan motor 74, insulation or acoustical foam 97 is placed on the inside of the intake cover 96. The cover 96 is preferably further configured to redirect the intake air 90 degrees from the axial center of the fan 76 and motor 74. This design promotes reflection of acoustical waves off of the noise-reducing acoustical foam 97. A wire or other locking mechanism 87 is provided to keep the filter cover 96 in place.

As shown in FIG. 15, the first outlet port 88 and second outlet port 90 may include first outlet port grate 92*a* and second outlet port grate 92*b*, respectively, to prevent fingers or hands from accidentally being pushed into the motor 74 (not shown). These grates are preferably integrally molded into the port outlets.

Referring to FIG. 16, in one preferred embodiment, a motor control board or circuit board 98 is contained in the housing 70 and includes a motor control, a controller 99, or, e.g., a microcontroller, for turning the motor on/off and further controlling the motor 74. This controller 99 may be in communication with several other sensors and/or subsystems, as will be described more fully below. The board 98 is preferably in communication with aluminum plate 72 which acts as a heat sink to channel heat away from the board 98. The plate 72 also acts as mounting platform for the board 98.

Figure 18:
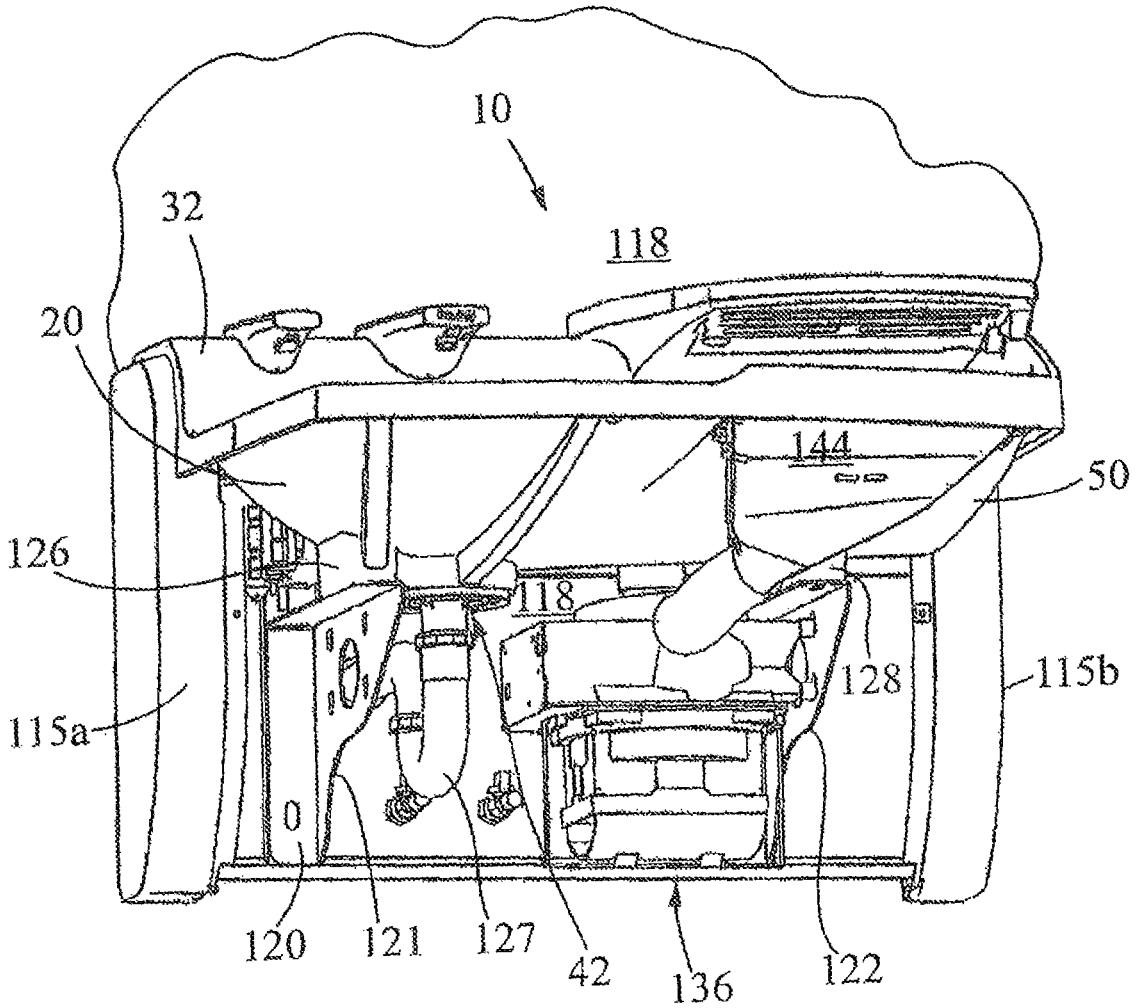
FIG. 18 is a lower front view of the lavatory system according to the present invention with a cover removed to show the mounting hardware.

As shown in FIG. 18, the lavatory system 10 is preferably attached to a lavatory wall 118 and can be mounted at different heights to accommodate adults, children, and those with disabilities. A frame 120 may be connected to the lavatory wall to support the lavatory system 10. The frame 120 preferably has two triangular-shaped brackets 121, 122 having flat surfaces, support columns 126, 128 on an underside of the wash basin 20 and hand dryer portion 50. A drain pipe 127 connects the drain 42 (see, e.g., FIG. 2) to the lavatory's plumbing behind the lavatory wall 118. Screws or other fastening means secure the brackets in place.

The frame 120 and drain pipe 127 are preferably covered by a lavatory system cover 130 (as best seen in FIGS. 1 and 2). The lavatory system cover 130 not only conceals the frame, motor, electrical connections, and plumbing, but it also preferably reduces the sound level experienced by the user. The cover 130 preferably also has brand indicia 131 and other user instructional indicia contained thereon. First end cap 115*a* and second end cap 115*b* help secure the cover 130 to lavatory system 10. The end caps 115*a*, 115*b* are preferably made of stainless steel and the cover 130 is preferably made of a plastic and/or resin material, e.g., a Class A fire-rated polymer. A primary air inlet 136 (see, e.g., FIG. 9) is preferably provided by creating a small gap between the lavatory wall 118 and the cover 130. The gap provides noise attenuation and also prevents foreign objects from getting sucked into the primary air inlet 136.

Figure 19:
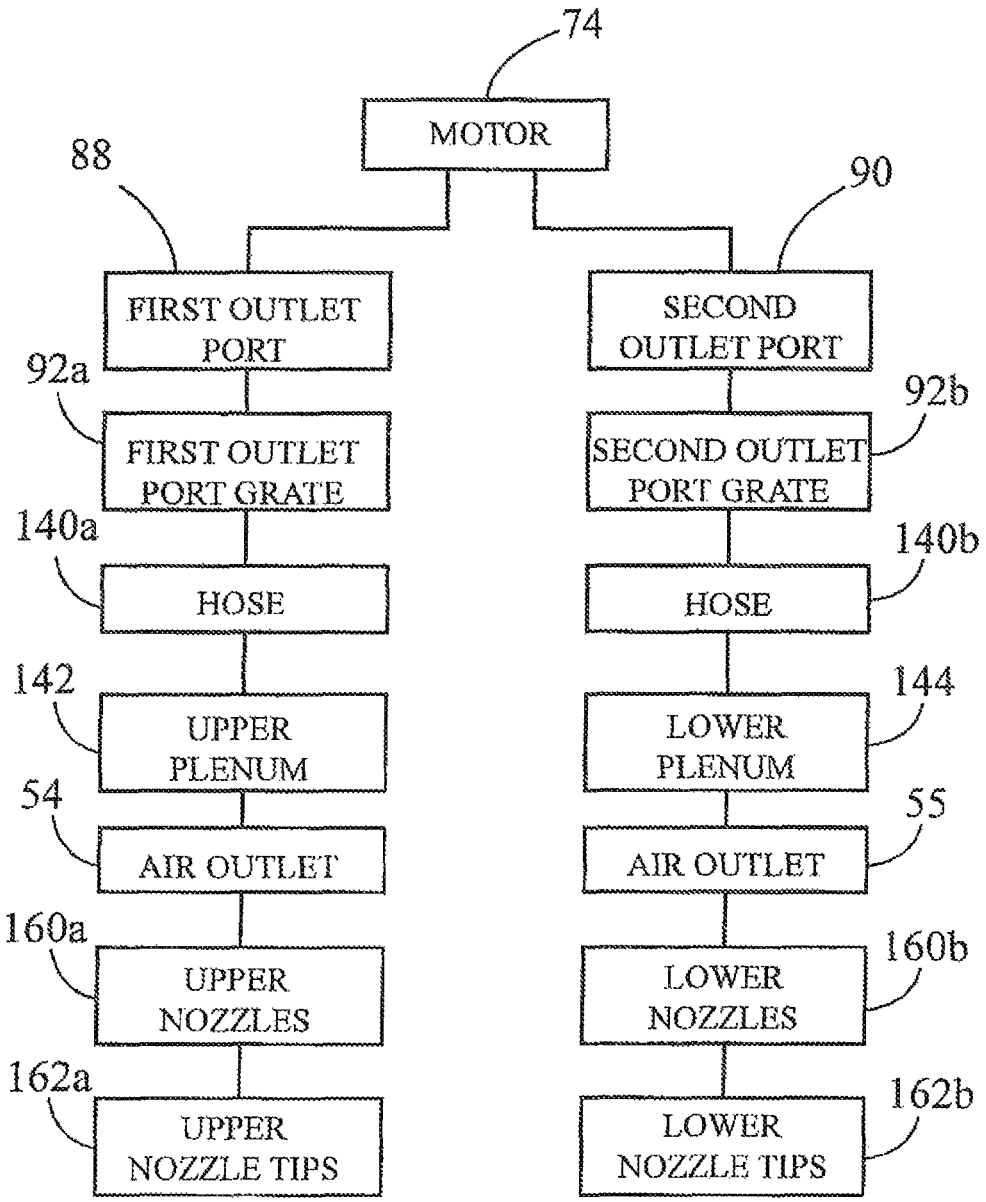
FIG. 19 is a block diagram showing a preferred air flow path from the hand dryer motor.

FIG. 19 is a diagram showing a preferred air flow for the blower 71 from the motor 74 and fan 76 out the first outlet port 88 and second outlet port 90. From the first outlet port 88, the air travels up through a grate 92*a* and via a hose 140*a* to a first or upper plenum 142 and out an air outlet 54. The air outlet 54 channels the air through individual upper nozzles 160*a* having upper nozzle tips 162*a* with air holes and into columns of air directed downwardly at a user's hands in the cavity. From the second outlet port 90, the air travels through a second outlet port grate 92*b* and via a hose 140*b* to a second or lower plenum 144 and out an air outlet 56. The air outlet 56 channels the air up through lower nozzles 160*b* having lower nozzle tips 162*b* with air holes and into columns of air directed outwardly at a user's hands in the cavity.

In a preferred embodiment, upper and lower nozzle tips 162*a*, 162*b* connected to the nozzles 160*a*, 160*b* emit high-speed colliding columns of air to shear water off the user's hand. The tips, holes, and resulting air columns are spaced and calibrated in such a way as to reduce forces on the user's hand which would otherwise move the hand toward the upper or lower plenums or the side surfaces. As mentioned, one way of accomplishing this spacing and calibration is to have the axis of the air flow from upper plenum 142 nozzle holes 164*a* angled about 1 degree from vertical and aimed toward the cavity back wall 60 (FIG. 9) and the axis of the air flow from lower plenum 144 nozzle holes 164*b* angled about 37 degrees from horizontal and aimed toward the cavity back wall 60. Moreover, the upper to lower nozzle tip spacing may be about 3.5 inches apart and the hand-receiving cavity 52 (see, e.g., FIG. 5) may have width of about 9.5 to 10 inches to provide the user with optimal comfort when using.

In one embodiment, the nozzles 160*a*, 160*b* preferably have tips 162*a*, 162*b* that are pointed protrusions that help pull static air into the air columns, see, e.g., FIGS. 12 and 14. These rows of nozzles are preferably mounted on two, approximately ten (10) inch, rectangular blocks or blades that fit, respectively, into the top and bottom air outlets 54, 56. The blades are preferably integral with the upper and lower plenums 142, 144. There are approximately 20 nozzles with tips formed or molded into each blade. These tips are approximately 0.050-0.060 inches long and have a diameter at the base of approximately 0.160-0.220 inches. The holes therein are preferably about 0.101 inches in diameter. From the center of one nozzle hole to the center of the next nozzle hole, it is preferably about 0.50 inches. As mentioned, the tips 162*a*, 162*b* preferably have a generally frustoconical shape to help prevent water from entering the nozzles 160*a*, 160*b* and also have about a 6 degree taper. In one preferred embodiment, the tips have a smooth, slightly rounded side wall to prevent catching of clothing or jewelry. When the dryer 50 is in use, the user's hands are preferably about 0.75 inches away from the nozzle tips.

As discussed, in one embodiment, the nozzles and holes on the top blade and the nozzles and holes on the bottom blade are at different angles from the horizontal plane and vertically aligned with one another so that the collision of the upper and lower streams of air provide a unique air flow pattern. This configuration preferably helps to generate an s-shaped airflow pattern. However, in another alternative embodiment, the holes and nozzles are lined up directly across the cavity from each other.

In one embodiment, the preferred bidirectional or dual-sided air flow dryer uses 1600 watts (or 13.7 amps) and will dry hands in about 15 seconds at 80 decibels (dB) with 70 cubic feet per minute (CFM). In this embodiment, the dryer runs off a 120V outlet and requires a dedicated 20 ampere (amp) circuit. Ground fault interruption (GFI) circuit protection is preferred. It is understood, however, that the invention is not limited to the above-referenced parameters. For example, it is contemplated that the dryer could run on a 15 amp circuit.

Figure 17:
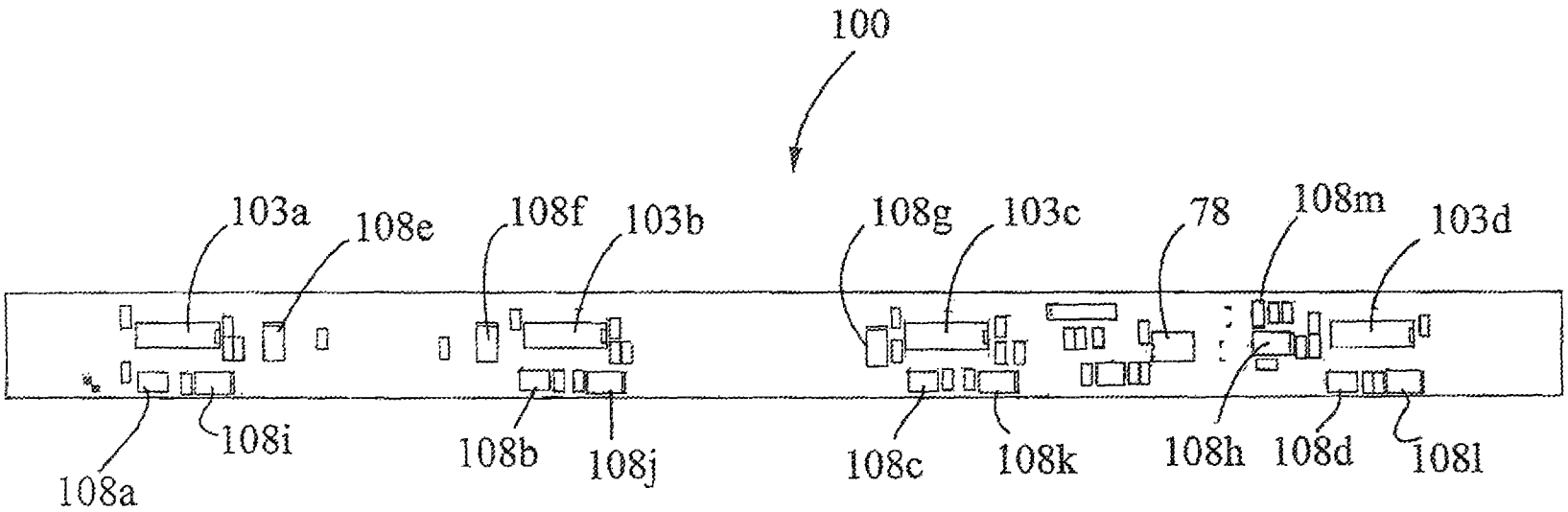
FIG. 17 is a view of the sensor board of the lavatory system according to the present invention.

Referring now primarily to FIG. 17, a sensor control board 100 is preferably provided in the top portion 53 near the upper plenum 142 (see, e.g. FIG. 9). The sensor control board 100 includes a controller 78, e.g., a microcontroller, and a multitude of sensors 103*a*, 103*b*, 103*c*, 103*d*. In the preferred embodiment, four proximity sensors (e.g., first, second, third, fourth proximity sensors) are provided in series. These work independently through triangulation to detect an object for drying 166, e.g., a user's hands, in the cavity 52 (see, e.g., FIG. 5). Lights or LEDs 108*a-m* may also be mounted to the control board 100. Some or all of the LEDs, e.g., LEDs 108*a*-1, may be activated when the first through fourth proximity sensors 103*a-d* detect an object for drying in the hand-receiving cavity 52.

In one embodiment, the LEDs 108*a-m* are operably connected to the hand dryer 50. For example, LEDs 108*a-d* continuously illuminate the hand-receiving cavity 52 at a low intensity level when a sensor does not detect the presence of an object for drying, i.e., the cavity is not in use or in "stand-by". However, when a sensor detects that an object for drying has entered into the hand-receiving cavity 52, and during dryer 50 activation, preferably the LEDs 108*e-h* and 108*i*-1 also illuminate cavity and thus increase the overall intensity level of light in the cavity. In another embodiment, LEDs 108*a-d* do not begin to illuminate the cavity until the soap is dispensed or the water begins to flow in the basin.

In a preferred embodiment, when a staff member wishes to clean and service the lavatory system 10, the staff member may engage a service mode. Here the LEDs 108*a-d* and 108*e-h* continuously illuminate the hand-receiving cavity 52. Activation of hand dryer 50 is also suppressed by communication between controller 78 and controller 99. In one embodiment, service mode activation is accomplished by triggering a sensor, e.g., the right-most sensor 103*d* in the upper portion of the hand-receiving cavity 52, for an extended time period. Thus, if this one sensor consistently detects an object for drying in the hand-receiving cavity 52, the hand dryer 50 is disabled for about 30 to 60 seconds and some of the LEDs, e.g., LEDs 108*e-h*, may be illuminated at a high-intensity level. This allows the hand-receiving cavity 52 to be temporarily cleaned without further engaging the hand dryer 50.

The LEDs, e.g., 108*i-l*, may flash in certain ways when the service mode has been started and/or is about to end. For example, in one embodiment, prior to the service mode, one row of four white LEDs provides lower level illumination of the hand dryer cavity. However, if the right-most sensor is triggered within the last 2 seconds, and if a hand is placed over the right-most sensor for the period of 3 seconds, a row of four amber LEDs will rapidly flash twice to designate that the unit is entering the service mode. At the same time, a second row of four white LEDs will turn on to increase the illumination of the hand cavity for approximately 30 seconds to assist in cleaning. After approximately 25 seconds from when the service mode was started, the row of four amber LEDs will flash three times to indicate that the service mode cycle is nearing completion. At the end of the service mode cycle (5 seconds after the four amber LEDs flash three times or about 30 seconds in total service cycle length), the second row of white LEDs will turn off and the hand dryer cavity will remain lit at the lower level of illumination by the first row of four LEDs.

In one embodiment, the service mode includes a controller 78, e.g., a microcontroller, with a programmed touchless cleaning mode feature wherein if one sensor is the only sensor activated within the last two seconds and if activated continuously for about three (3) seconds, the hand dryer 50 will enter the mode to allow cleaning of the hand dryer 50. This mode lasts for about 30 seconds, during which dryer activation is suppressed, and then the controller will return the system to normal operation. The controller will flash the LED lights twice when entering the cleaning mode and three times when approaching a time near the end of a cleaning cycle which is approximately 25 seconds into an about 30 second cleaning cycle. If the cleaning mode is longer in another embodiment, the lights will flash three times, 5 seconds before the end of the cleaning cycle.

Figure 20:
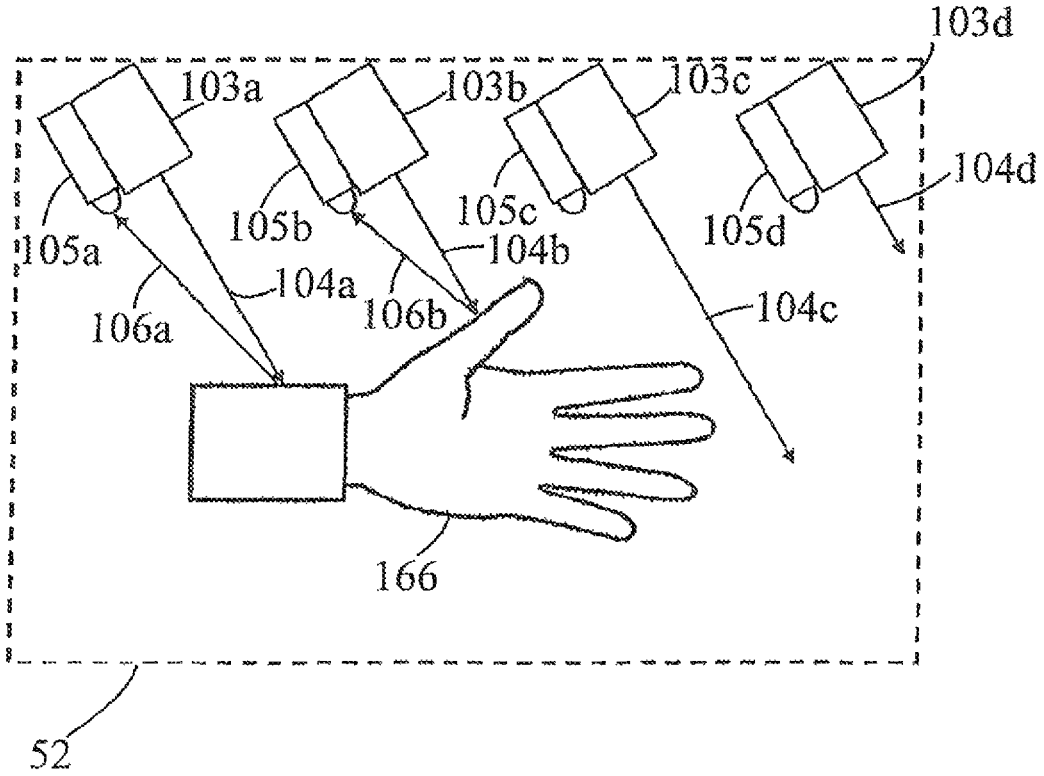
FIG. 20 is a diagram showing the hand dryer sensors according to the present invention interacting with a hand.

FIG. 20 is a diagram showing triangulation of the sensors 103*a*-103*d* in detecting an object for drying in the hand-receiving cavity 52, e.g., a user's hand 166. In a preferred embodiment, it should be noted that hand entry occurs at an oblique angle. Hand 166 entry angles range from approximately 5 to 50 degrees from horizontal depending on the user's height and the mounting height of the lavatory system 10. For example, sensors 103*a-d* may be infrared (IR) sensors with emitter sections emitting IR light 104*a-d*, respectively. The IR light 104*a* and 104*b* may be reflected by hand 166. Each IR sensor 103*a-d* also has a detection module 105*a-d*, respectively.

The sensor detection modules 105*a* and 105*b* utilize an internal triangulation algorithm to sense IR light, 106*a* and 106*b* respectively, when an object for drying is in the sensor's field of view. When a user's hand 166 enters the hand-receiving cavity 52, the sensor detection modules 105*a* and 105*b* output an electrical signal (e.g. a 5 volt signal).

This signal is used by the controller 78 to determine whether to activate the hand dryer (50) and LED lights 108*e*-1 (see FIG. 17).

Figure 21:
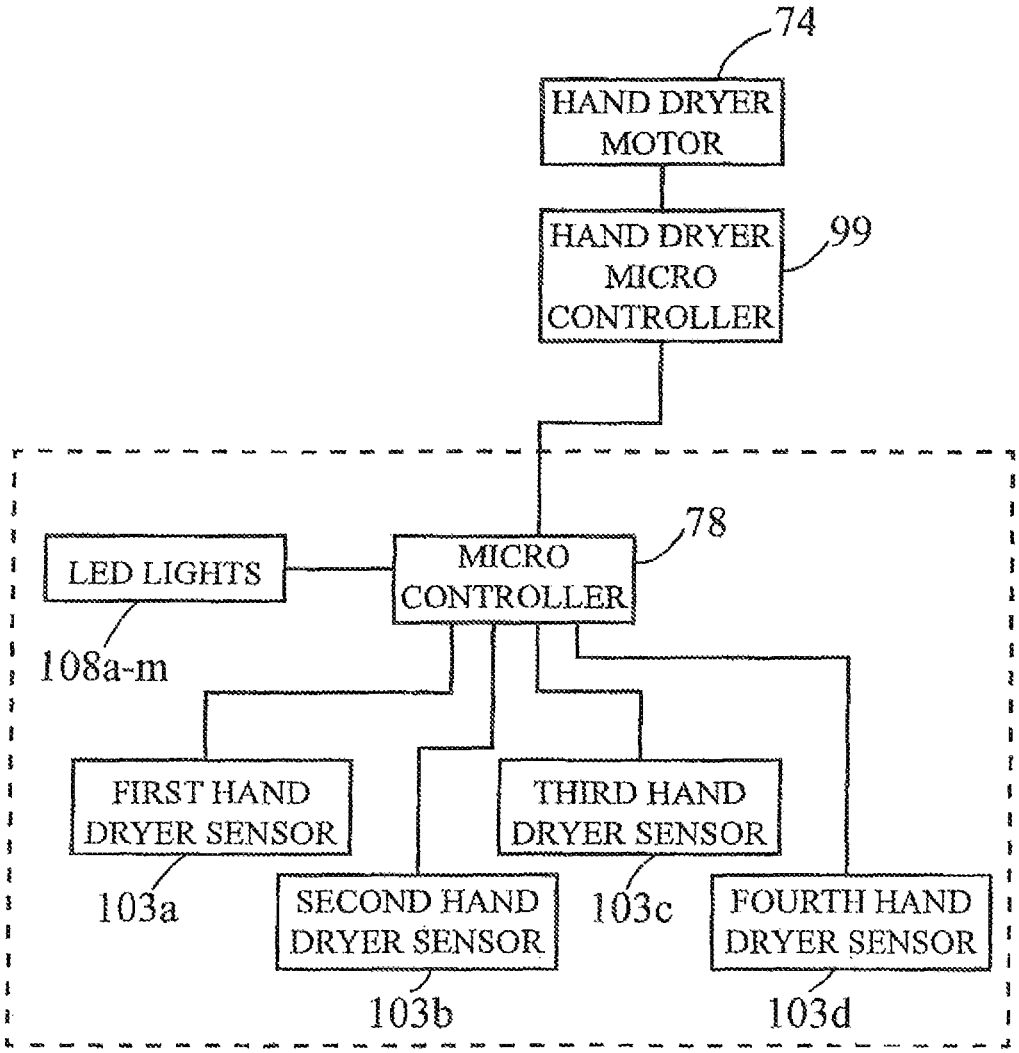
FIG. 21 is a block diagram showing the hand dryer electrical components.

FIG. 21 is a diagram showing a preferred electronic control communications embodiment. In this embodiment, at least one controller 78 communicates with the various subsystems, e.g., the first, second, third, and fourth hand dryer sensors 103*a-d*, LED lights 108*a*-1, and hand dryer 50 (including hand dryer motor's controller 99). In this embodiment, the controller 78 may include a pre-programmed programmable unit having a time delay mechanism for turning the subsystems on and off in a certain sequence. Of course, it is appreciated that one or more controllers may be used, for example, one for each subsystem, and may therefore be configured to communicate with each other. In one embodiment, a sensor control board or circuit board 100 (see, e.g., FIG. 17) is provided and includes a controller 78 and a single bank of sensors (103*a-d*) to measure distance by triangulation. There may also be present on this sensor control board 100, LEDs 108*a-d* that will continuously illuminate the hand-receiving cavity 52. LEDs 108*e-h* and LEDs 108*i*-1 may also be present and illuminate when the sensors 103*a-d* detect a user's hand 166 in the cavity. In one embodiment, white lights are used when the dryer is in standby, and amber lights are used when the dryer is in use.

A programmable unit may be present on the sensor control board 100 and/or motor control board 98 and preferably includes a time-delay mechanism, for example, in communication with an on/off switch for the motor 74. In this embodiment, when one of the sensors 103*a-d* is activated by an object for drying, e.g., a user's hands, in the hand-receiving cavity 52, the controller 78 rechecks the activated sensor multiple times to validate that hands are in the hand-receiving cavity 52. Then the delay mechanism allows users to enter their hands 166 fully into the hand-receiving cavity 52 prior to the hand dryer motor 74 achieving full speed. This minimizes the potential of any splashing of water back on the user as a result of the fully active hand dryer imposing a shearing action on water present on the user's hands. There may be additional sensors (not shown) that may inhibit the dispensing of water or soap or activation of the dryer when a critical water level is reached in the wash basin and thus prevent overflow, flooding, and/or motor damage.

In another embodiment, there is communication between the faucet sensor controller and the dryer sensor controller. For example, when the faucet is used, the lights on the dryer go from off to on, e.g., to white. This feature could be used to indicate to the user that the user should move from the faucet to the dryer next, and thus make the wash station use more intuitive. This feature could also lock the faucet off while the user's hands are being dried. This would save water as it would truncate the faucet turn off time. It would also eliminate any splashing due to the dryer air flow through the basin.

In one embodiment, multiple distance sensors 103*a-d* utilize triangulation one at a time and from left to right in their field of view to detect an object for drying. These sensors are preferably positioned so they are recessed in the upper portion 53 and aimed vertically into the hand-receiving cavity 52. Recessing is minimal, however, to avoid adversely impacting sensor operation. In one embodiment, the sensor board 100 is programmed to check all sensors at about 130 millisecond (ms) intervals. When a sensor flags a detection, it is then rechecked fifteen times over about a 15 ms period to ensure the detection was not a false trigger.

The temperature rise of the air during a drying cycle is dependent upon how long the user keeps the hand dryer 50 activated. Since the system 10 does not use an auxiliary air heater, the air temperature rise is a result of the heat generated by the inefficiency of the motor 74. The other factor dictating the motor temperature rise is how frequently the motor 74 is activated. In a high usage environment (airport, sports arena, etc.), the motor 74 will not typically cool down very much between cycles and the air temperature rise experienced by the user will be significantly higher than that of a hand dryer which operates infrequently. The following chart shows some typically-expected temperature rises.

| Drying Cycle | Cycle Length | Expected Temperature Rise Above Ambient Temperature (F.) @ 120 V (rated operating voltage) |
|---|---|---|
| Normal | 12-15 seconds | 12-50 |
| Maximum | 30 seconds | 22-50 |

In one embodiment, additional safety and cleaning features may be present. For example, UV lighting or some other sterilization technique to disinfect the hand-receiving cavity 52 may be provided. Further, only one drain may be provided between the wash basin 20 and outside of hand-receiving cavity 52 to eliminate the need for another device to catch water from the dryer 50 that must be emptied and can collect harmful molds or germs. Certain dryer components, like the nozzles 160*a*, 160*b*, may have an antimicrobial additive molded into the plastic. Further, the entire wash basin 20 and hand-receiving cavity 52 may be constructed, in part, of an antimicrobial material or may be coated with such a material during manufacture.

In one embodiment, a second row of holes, a slot, and a port are present to provide a lower velocity air stream to further minimize water splashing onto a user.

Figure 22:
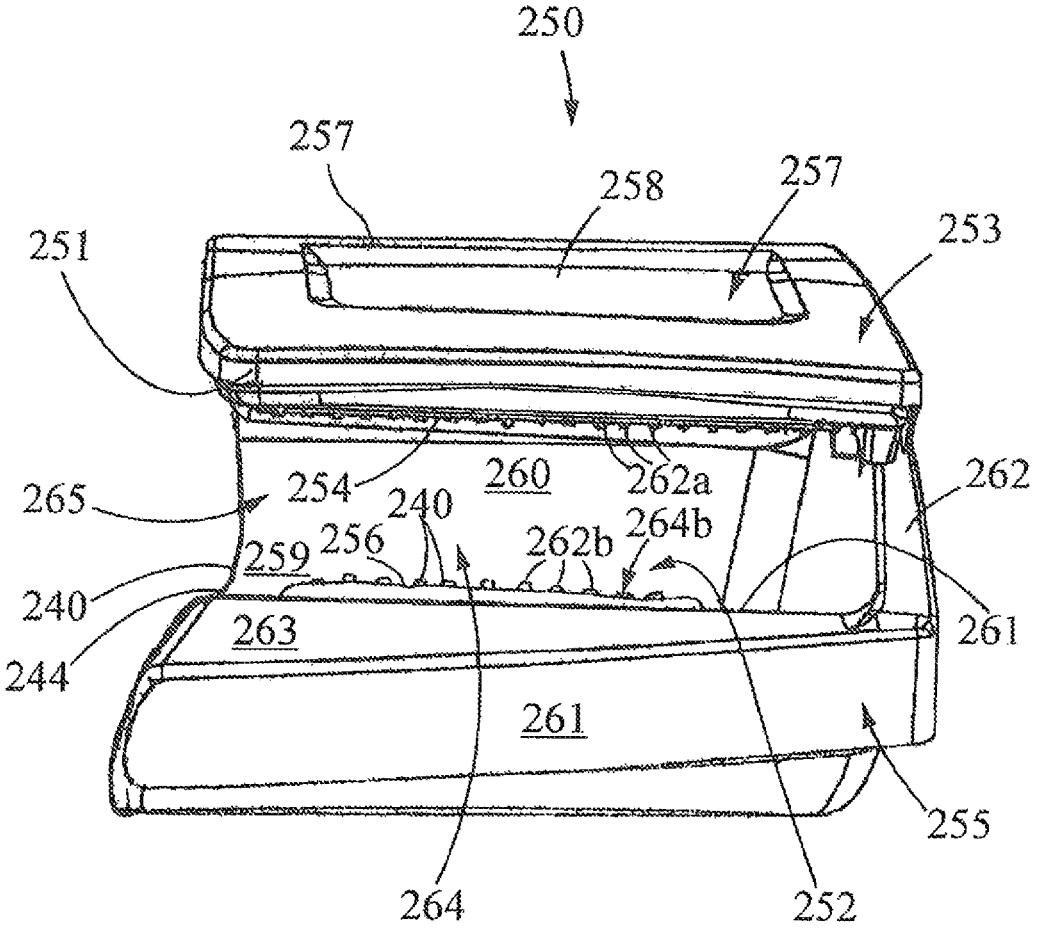
FIG. 22 is a front elevation view of another embodiment of a lavatory system according to the present invention.

In the embodiment shown in FIG. 22, the drying system or dryer 250 may be a stand-alone unit but still mounted in close proximity to the wash basin. In this embodiment, lavatory hand dryer 250 includes a hand-receiving cavity 252, a top portion 253, a bottom portion 255, a back side or wall 260, and at least one side wall 262. Note that while a right side wall is shown, the dryer may have only a left side wall. Alternatively, two side walls or partial side walls may be present. The top portion 253 may also include a hood 251 which forms a top wall or side 257 of the cavity 252. The top portion hood 251 may also include a top portion cover which may form a shelf 258. An upper air outlet 254 is also provided in the top or upper portion 253 and incorporates nozzle holes 262*a*.

A bottom portion 255 includes a lower air outlet 256. The bottom portion 255 is formed, in part, by a bottom wall or side 259. The bottom portion 255 of the hand-receiving cavity 252 also includes a back wall or side 260, front wall or side 261, and side wall 262. A front ledge 263 is integral with the front wall 261. The hand-receiving cavity 252, therefore, is preferably configured to have a front opening 264 and a side opening 265 (shown on the left side). In this embodiment, the dryer's configuration and placement preferably allows the user to easily transition the hands from the wash basin to the dryer without dripping water onto the floor.

In one preferred embodiment, a mechanism 240 for preventing flooding and damage to the hand dryer motor is provided as well as to prevent water blown from a user's hands from falling to the floor and creating a slip hazard or unsanitary conditions. The mechanism 240 may include a flood relief rim 244 located on, for example, the left side of the hand-receiving cavity 252 at the opening 265. The flood relief rim 244 is provided below the lower portion's air outlet 256 and the nozzle tips 262*b* as shown. Thus, water flows over the flood relief rim 244 and not down the nozzle holes 264*b* and into the motor (not shown). In addition, another motor protection mechanism 240 may be the frustoconical lower nozzle tips 262*b* which resist the entry of water.

Other preferred embodiments of the hand dryer 250 may include a side wall 262 on the left side and an opening 265 on the right side. In yet another preferred embodiment, the hand dryer 250 may include both a left side, side wall and a right side, side wall.

The primary components of the inventive lavatory system including the dryer bottom wall, a back wall, and single side wall are preferably formed from a plastic and/or resin material. In one embodiment, the system components may be formed from a solid polymeric and/or a polymeric and stone material. In another embodiment, the system components may be manufactured from Terreon® or TerreonRE® which are low emitting, e.g., Greenguard™ materials and available from the Bradley Corporation of Wisconsin.

Figure 23:
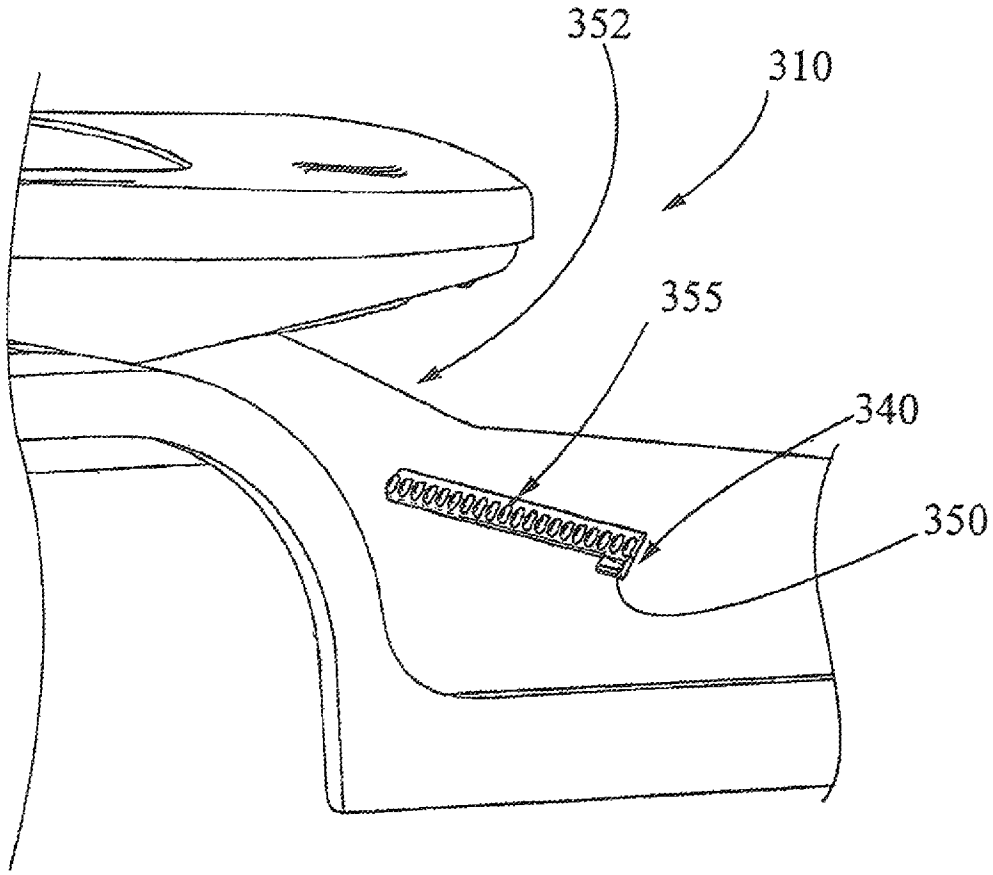
FIG. 23 is a side view of a cutaway portion of still another embodiment of the lavatory system according to the present invention illustrating a hand dryer, drain hole, and lower nozzle portion.
Figure 24:
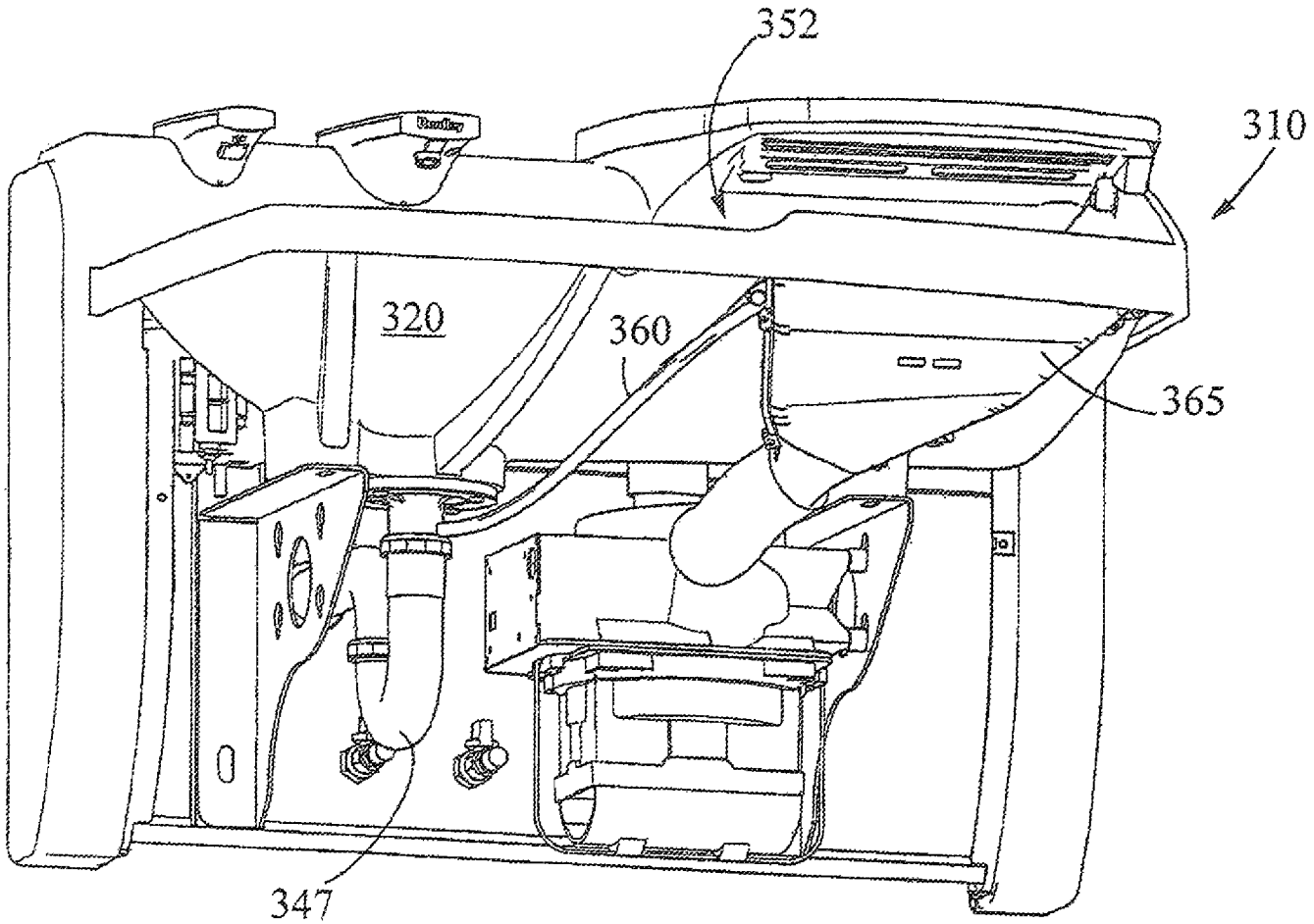
FIG. 24 is a lower front view of the embodiment of FIG. 23 according to the present invention with a cover removed to show a drain tube and drainpipe.

In another embodiment, as best shown in FIGS. 23 and 24, lavatory system 310 has another mechanism 340 to prevent flooding of the motor (not shown). For example, as shown a drainage hole 350 is present in a lower portion of the hand-receiving cavity 352 to preferably provide an integrated overflow drain. Hole 350 is connected to a drainage tube 360 and is located slightly below the plenum 365 and plenum outlet 355 and nozzle holes to prevent flooding of the motor. The drainage tube 360 connects to the drainpipe 347 located beneath the basin 320. Of course, as is know in the art, traditional drainage systems, like weep holes in the basin itself, may also be provided.

As described above with respect to FIG. 17, the top portion 53 of the upper plenum 142 has, in one embodiment, first, second, third, and fourth proximity sensors 103*a*, 103*b*, 103*c*, 103*d*, respectively, that work independently through triangulation to detect an object for drying, i.e., user's hand(s), in the hand-receiving cavity 52. In one embodiment of the lavatory system 10, as shown particularly in FIG. 7, the sensors 103*a*, 103*b*, 103*c*, 103*d* are positioned adjacent the leading edge of the top portion 53 of the upper plenum 142. As described above, the sensors use triangulation to detect an object for drying being presented to and present within the hand-receiving cavity 52. With additional reference to the schematic view in FIG. 25, the sensors 103*a*, 103*b*, 103*c*, 103*d* are configured and arranged to have non-overlapping fields of view ("FOV") 266*a*, 266*b*, 266*c*, 266*d*, respectively. When a user's hand(s) are presented to the hand-receiving cavity 52, the left-most sensor 103*a* first detects the presentment and provides a corresponding electrical signal to the controller 78, which in turn provides a command signal to the hand dryer controller 99. As described above, in one preferred embodiment, operation of the hand dryer is delayed by a preset value, e.g., 400 ms, upon detection of a user's hand being presented to the hand-receiving cavity.

As shown in FIG. 5, the configuration of the hand-receiving cavity 52 allows a user to present his hand(s) for drying from the side opening 65 of the hand-receiving cavity 52, such as along arrow 267 of FIG. 1, or from the front opening 64 of the hand-receiving cavity 52, such as along arrow 268 of FIG. 9. In the case of the latter, depending upon the lateral position of the user's hand(s), any of the sensors may first detect the user's hand(s) and provide a corresponding activation signal, as described above. It has been found that when hand(s) are front-presented (e.g., along 268), as opposed to side-presented (e.g., along 267), the observed inherent motor delay that results from sampling, detection, and processing times is insufficient to avoid splashback onto the user. That is, a single motor delay based solely on side-presentment to the hand-receiving cavity can result in splashback onto the user when the user presents his hand(s) to the hand-receiving cavity 52 from the front.

Figure 26:
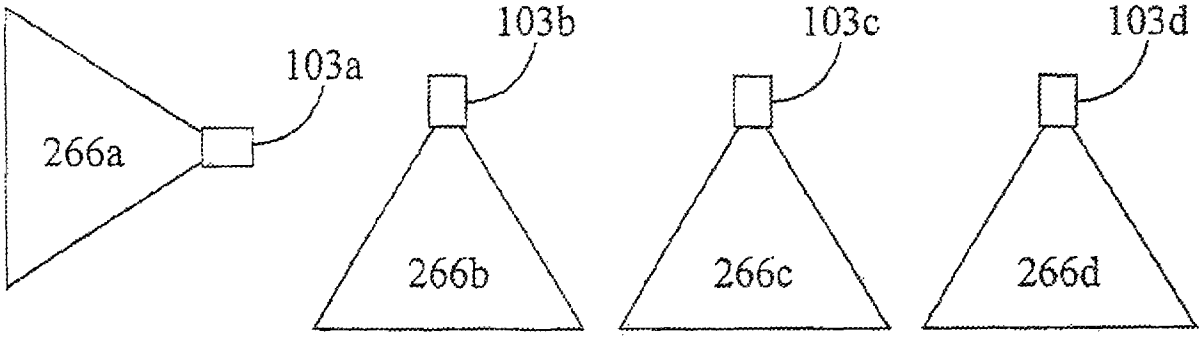
FIG. 26 is a schematic view of the fields-of-view provided by a bank of proximity sensors according to an alternate embodiment of the invention including first and second proximity sensors.

Therefore, in accordance with another embodiment of the invention, one of two motor delays is selectively observed depending on how the user presents his hand(s) for drying. Referring now to the embodiment shown in schematic view in FIG. 26, the sensors 103*a*, 103*b*, 103*c*, 103*d* are arranged such that the FOV 266*a* for sensor 103*a* is rotated approximately 90 degrees from the FOVs 266*b*, 266*c*, 266*d*. In this regard, sensor 103*a* is arranged to only detect side-presentment along arrow 267 to the hand-receiving cavity 52. The FOVs 266*b*, 266*c*, 266*d* for the other sensors 103*b*, 103*c*, 103*d* can detect front-presentment along arrow 268 as well as detect a user's hand(s) within the hand-receiving cavity 52, as described above. As sensor 103*a* only detects side-presentment along arrow 267 to the hand-receiving cavity 52, actuation of the hand dryer motor 74 can be controlled based on which sensor detects presentment to the hand-receiving cavity.

For example, and in one preferred embodiment, if the first hand sensor 103 detects hand presentment to the hand-receiving cavity 52, the sensor 103*a* provides a corresponding electrical signal to the controller 78. The controller 78 includes software or firmware that distinguishes between an electrical signal being received from first sensor 103*a* versus the second, third, and fourth sensors 103*b*, 103*c*, 103*d*. With knowledge that the first object detection signal came from sensor 103*a*, the controller 78 provides hand dryer motor activation signal to the hand dryer controller 99. This motor activation signal results in the hand dryer motor being activated after a first programmed delay period, e.g., 0-300 ms. However, if any of the other sensors 103*b*, 103*c*, 103*d* provides a first detection signal to the controller 78, the hand dryer controller 99 causes operation of the hand dryer motor 74 after a second programmed delay period, e.g., 200-800 ms. The first and second delay periods are selected such that the second delay period preferably exceeds the first delay period. Thus, in one embodiment, operation of the hand dryer motor is delayed further if a user presents his hand(s) to the hand-receiving cavity 52 from the front. This allows more time for the user to move his hands deeper into the hand-receiving cavity 52 before the blower provides drying air to the hand-receiving cavity. Preferably, the drying airstreams are provided at approximately wrist level in the hand-receiving cavity 52, and observing a longer delay before commencing drying when hands are front-presented allows the user sufficient time to insert his hands to the wrist level position before air is injected into the cavity 52.

It is contemplated that more than one controller may be used to provide command signals to the hand dryer controller 99. For example, the first hand dryer sensor 103*a* may be coupled to a dedicated controller whereas the other sensors 103*b*, 103*c*, 103*d* communicate with a shared controller, similar to that shown in FIG. 21.

In accordance with an alternate embodiment of the present invention, the hand dryer 50 may include a second bank or set of sensors. These sensors are mounted along a side portion of the upper plenum and are designed to sense side-presentment 267 of a user's hand(s) to the hand-receiving cavity. The afore-described sensors 103*a*, 103*b*, 103*c*, 103*d* are mounted adjacent the front of the hand-receiving cavity. Preferably, the respective sets of sensors have mutually exclusive FOV so that side-presentment from opening 65 of a user's hand(s) is not detected by the front-facing sensors and front-presentment from opening 64 of the user's hand(s) is not detected by the side-facing sensors.

Each set of sensors is operative to provide activation commands to the motor to commence operation of the motor. However, the front-facing sensors, upon detecting an object for drying 166 within their FOV, instruct the motor to commence activation after observing a longer second delay period than that provided to the motor by the side-sensing sensors. In one embodiment, the longer second delay period falls in the range of approximately 200-800 ms whereas the shorter first delay period falls in the range of approximately 0-300 ms. Note that these values are merely exemplary, and the first and second delay periods are preferably selected such that the second delay period exceeds the first delay period.

Figure 27:
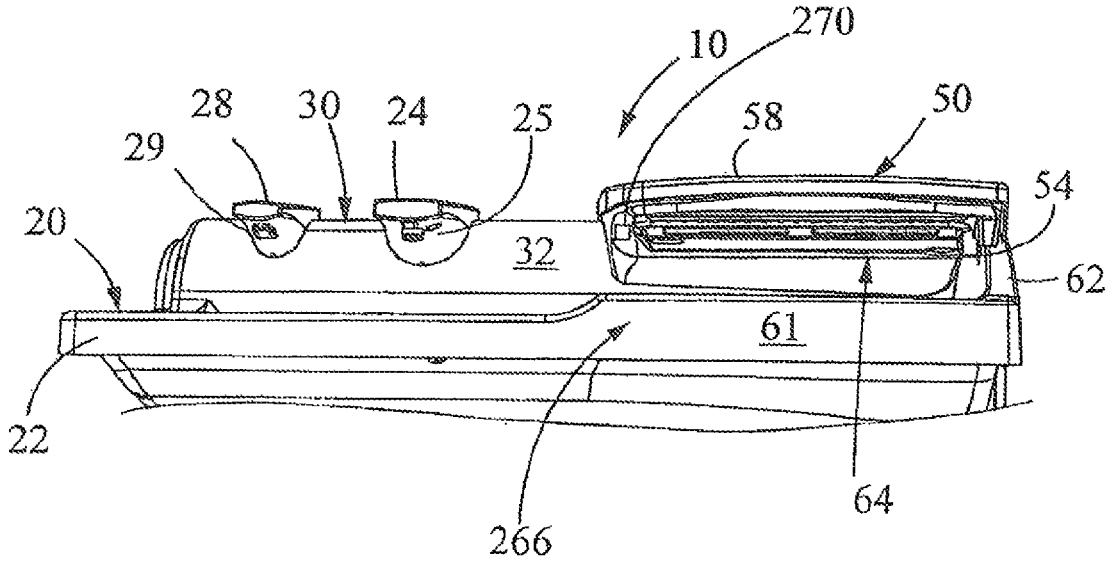
FIG. 27 is a front elevation cutaway view of a lavatory system according to a further embodiment of the present invention.

In accordance with yet another embodiment of the present invention, a single sensor is used to detect side or front presentment of a user's hand(s) from openings 65 and 64 respectively into the hand-receiving cavity 52. In this embodiment, which is shown in FIG. 27, a single sensor 270 with a rotating FOV is positioned at a corner of the top portion 53 near the upper plenum 142. The single sensor 270 has a continuously rotating or wide FOV that travels across the area adjacent the side of the hand-receiving cavity 52, the front side of the hand-receiving cavity, and the within the hand-receiving cavity. As the FOV is rotated across the side and the front of the hand-receiving cavity, correlating the position of the FOV when the sensor 270 detects an object for drying can be used to determine if the user is presenting his hand(s) in a side-presentment or a front-presentment manner. For example, in one embodiment, the sensor 270 has a pulsating emitter and a detector. The emitter is configured to iteratively pulse an IR beam beside, in front of, and within the hand-receiving cavity. Based on which reflected pulse is detected by the detector, the controller 78, e.g., microcontroller, can determine the presentment position of the user's hand(s) and control the hand dryer motor controller 99 accordingly. It is contemplated that other types of means may be used to sweep the FOV of the sensor 270 across the drying zone 266.

In yet another embodiment that is similar to that described above with respect to FIG. 26, it is contemplated that the sensors are sequentially pulsed to determine the position of the user's hand(s).

Figure 25:
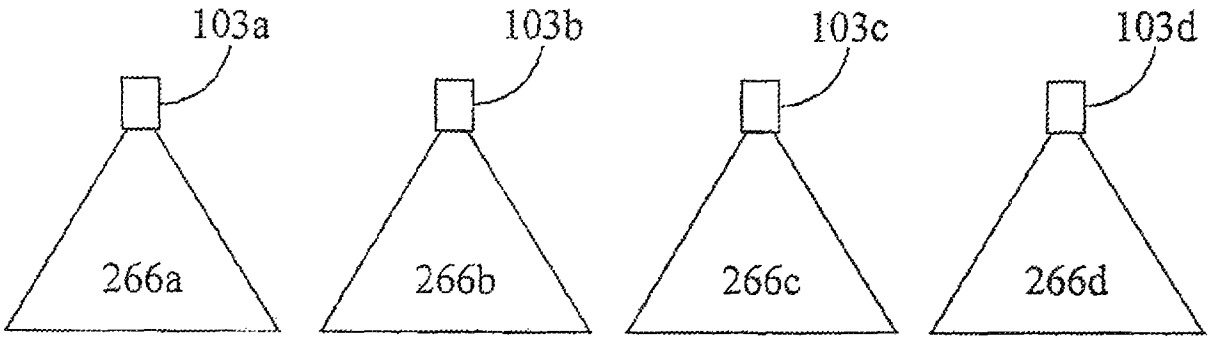
FIG. 25 is a schematic view of the fields-of-view provided by a bank of proximity sensors according to one embodiment of the invention including first and second proximity sensors.

It will also be appreciated that the present invention can be embodied in a method of controlling the drying operation of a hand dryer 50 based on the position at which a user presents his hand(s) to a drying cavity or chamber 52 having at least two points of entry, for example, the side opening of drying chamber 65 and the front opening of drying chamber 64. (See, e.g., FIGS. 5 and 6A). The first point of entry or ingress 65 is the side of the drying chamber 52 while the second point of entry or ingress 64 is the front of the drying chamber 52. In accordance with one embodiment of this method, as shown in FIG. 25, the method includes iteratively scanning a first detection zone 266*a* including near the first point of ingress 65, iteratively scanning a second detection zone 266*b* including near the second point of ingress 64, supplying drying air with a first delay if an object is detected in the first zone 266*a*, and supplying drying air with a second delay if an object is detected in the second zone 266*b*, wherein the second delay period is greater than the first delay period In one implementation, the first delay period is a value between zero and 300 ms whereas the second delay period is a value between 200 and 800 ms, and the first and second delay periods are selected such that the second delay period exceeds the first delay period.

It will be appreciated that infrared sensors for detecting the ingress and egress of hands to and from the front of drying chamber 64 and the side of drying chamber 65 are but one of a number of different object-detecting technologies that could be used to detect an object for drying 166 in the drying chamber 52. For example, it is contemplated that camera and image processing technology could be used.

Further, it is contemplated that the invention could be used with a lavatory system having a single dryer situated between a pair of wash basins. It is also contemplated that sensors remote from the hand dryer 50 could determine the direction of presentment. For example, sensors at or near the water faucet could detect motion of the hands after the water faucet has stopped dispensing water. If the hands are pulled away from the faucet, the hand dryer 50 could be caused to operate with a front-presentment (e.g., along 268) to the hand-drying cavity assumed. If the hands are moved sideways from the faucet, a side-presentment (e.g., along 267) to the hand-drying cavity could be presumed.

It is also noted that so-called "smart" technology could be incorporated into the lavatory system described herein to guide or sequence use of the various components of the lavatory system. For example, the lavatory system could be equipped with directional lights that guide (or at least remind) the user to apply soap and, after washing, slide his hands into the drying chamber. Similarly, it is contemplated that the various components could be selectively locked out to prevent simultaneous activation of two components. For instance, it may be undesirable to have the water faucet capable of being activated when the dryer is forcing air into the drying cavity. If the water faucet was dispensing water while the dryer was active, it could lead to undesirable splashing of the water. Additionally, locking out certain components or features of the lavatory system may also sequence use of the lavatory system. For example, water faucet and dryer operations may be locked out until the soap dispenser has been activated. In such a situation, the afore-mentioned lights or similar devices could be used to direct the user to first apply soap to his hands before watering or drying his hands. Such a system may be highly preferred in food-handling operations, such as restaurants.

Referring again to FIG. 16, in a preferred embodiment of the invention, a filter, i.e., HEPA filter 84, is provided within the motor housing 70 to filter the intake air. In a further embodiment, a filter sensor 272 is provided to monitor the condition of the filter 84, e.g., by analyzing air flow through the filter. In one embodiment, the filter sensor 272 is a differential pressure (or vacuum) transducer that is located between the filter 84 and the intake to the motor 74, such as in intake cavity 274. The transducer measures the difference in pressure between atmospheric pressure and the vacuum in the intake cavity 274. As such, the filter sensor 272 is also fluidly connected to a vent hose 276 that is vented to atmosphere. The filter sensor 272 is connected to logic (not shown) of the motor control 98 in a conventional manner such that operation of the motor 74 can be controlled based on the condition of the filter 84.

In one preferred method of use, one of four actions is taken based on the output of the filter sensor 272 and thus, preferably, the output of the filter sensor 272 is compared by the logic to potentially three different predefined levels. When the filter sensor 272 output is below a first vacuum level, as detected by the filter sensor 272, an indicator, e.g., light 278 (FIG. 1), is illuminated to indicate a "missing filter" condition has been detected and thus, signals a user or maintenance personnel that the filter 84 needs to be installed to prevent the ingress of foreign objects into the hand dryer apparatus. When filter sensor 272 output is between the first and a second vacuum level, no action is taken, thereby indicating that the filter 84 is operating properly. However, if the filter sensor 272 output reaches a second vacuum level, an indicator, e.g., light 278 (FIG. 1), is illuminated to indicate a "dirty filter" condition has been detected and, thus, signals a user or maintenance personnel that the filter 84 must be replaced. An audible alarm may also sound. At a third vacuum level, as detected by the filter sensor 272, the motor controller 98 can shut down and disable operation of the motor 74 to prevent damage to the motor 74 or other components of the dryer. Maintenance personnel will then know to replace the filter. In addition, if a non filter related obstruction occurs in the air intake system upstream of the air filter sensor 272 (e.g., bathroom tissue plugging an inlet), and causes the output of the air filter sensor 272 to exceed a predetermined vacuum level, the air filter sensor 272 can trigger a service requirement, indicate a blocked inlet condition, and/or disable operation of the motor 74. Because the air filter sensor 272 detects the operating characteristics of the air flow within the motor air intake, the sensor provides feedback on the actual condition of the air filter. It will be appreciated that the invention actively monitors the operability of the filter rather than relying upon a predetermined number of cycles to indicate that a filter service is required.

In an alternate embodiment, a small tube (not shown) has an inlet end that is in fluid communication with the intake cavity 274 and an outlet end that is vented to atmosphere. In this embodiment, the filter sensor 272 is fluidly connected to the tube. In this embodiment, it will be appreciated that the filter sensor 272 remotely monitors the pressure (vacuum) in the intake cavity.

While the preferred embodiments and best modes of utilizing the present invention have been disclosed above, other variations are also possible. For example, the materials, shape, and size of the components may be changed. Additionally, it is understood that a number of modifications may be made in keeping with the spirit of the system 10 of the present invention. For example, the system 10 may include features of the various embodiments set forth in PCT Publication Nos. WO2007/083092 and WO2007/015045 to Dyson, and US Publication Nos. US2008/0109956A1 published on May 15, 2008 and 2006/0185074 published on Aug. 24, 2006, all of which are expressly incorporated herein by reference. Further, a number of lavatory systems like the one shown in FIG. 1 can be mounted in a row or otherwise joined together as needed.

In addition to the above-described features and attributes, the present invention further provides for a lavatory system having one or more of the following features: (1) a color LED display 200 shown in FIGS. 2 and 5; (2) system diagnostics system 202 shown in FIG. 21; (3) lavatory system communications system; (4) active noise cancellation 204 shown in FIG. 21; (5) various color and material combinations; (6) universal power supply; (7) sterilization features; (8) various nozzle designs; (9) plumbed dryer drain; and (10) energy savings. Each of these features will be generally described below.

Incorporating a display, and preferably a color LED display, at one or more viewable portion of the lavatory system 10 facilitates the display of various types of information to an onlooker, such as a user or serviceperson. For example, the LED display could be used to display graphic or textual instructions to a user including, but not limited to, how to use the integrated lavatory system 10. That is, in addition to directing a user through the soaping, washing, and drying stations, the LED display could be used to provide guidance to a user as to how to lather soap, rinse, and dry. Diagnostic information, which will be described below, can be collected regarding use of the lavatory system 10, and can be displayed on the LED. It is contemplated that the LED display could be of the touch-screen type to facilitate user interaction therewith or include other I/O tools, such as buttons, and the like. It is further contemplated that the LED display could be used to display advertisements and similar consumer-driven notifications.

As noted above, the LED display could be used to display diagnostic information, such as to a serviceperson. In this regard, the lavatory system 10 may include an integrated data collection ("diagnostics") system that collects operational and performance data. For example, the diagnostics system may include sensors and the like that collect data regarding motor run time, soap level, period between use cycles, filter status, water used, water tray level indicator, and the like. Similarly, the LED display could be used to set operational parameters for the lavatory system, such as motor run time, faucet run time, volume of soap dispensed per cycle, and the like.

In one embodiment, the diagnostic information is acquired and stored and/or displayed locally, such as on the afore-described LED display. It is also contemplated that the diagnostic data could be transmitted to a centralized facility, such as a maintenance or operations room, for remote monitoring. This would allow service personnel to remotely monitor operation of multiple lavatory systems without having to visually inspect each lavatory system. The diagnostic information could be communicated across wired or wireless communication lines in a conventional manner.

One skilled in the art will appreciate that, in general, the greater the blowing force, the quicker hands may be dried in the drying cavity. However, an increased blowing force also increases the amount of noise emitted during a hand-drying cycle. To cancel or reduce the noise generated by the hand dryer, the lavatory system 10 preferably includes noise cancellation features. The noise cancellation features can include, but are not limited to, mechanical and/or electrical noise cancellation devices. For example, an electrical amplifier could be used to provide noise cancellation for select objectionable acoustical frequencies such as the noise signature of the blower motor or high speed air striking the users hands. The material makeup of the lavatory system could include sound-absorbing material or sound-absorbing panels. In this regard, it is contemplated that the lavatory system 10 could be manufactured from numerous materials, or combinations thereof, to provide a sterile yet noise abated washing environment.

It is envisioned that the lavatory system 10 described herein could be used in a number of different geographical locations and, as such, be equipped to handle different input voltages. Preferably, the lavatory system has a power circuit that allows the lavatory system 10 to be used universally without requiring significant modifications to the blower motor or any other device in the lavatory system. Also, the blower motor assembly may provide power to all other items on the lavatory system.

Reducing bacteria and germ growth in commercial lavatory systems is also important. To this end, the present invention contemplates that one or more sterilization features may be integrated into or used with the lavatory system 10. For example, ultraviolet (UV) light could be emitted into the drying chamber. The energy from the UV rays could be used to eradicate bacteria and other germs on the user's hands. Alternately, a separate UV chamber could be added to the lavatory system 10 into which a user slides his hands after drying for an optional sterilization stage. To further reduce contaminants in the drying chamber, it is understood that an air purification device could be used with the lavatory system 10. For instance, an air filter or air purifier could be placed in or near the air outlet of the blower so that air that is emitted through the nozzles 162, 164 is filtered. The purifier could be placed at the air inlet to the blower and the blower speed could be varied such that the hand dryer outlet air is emitted at high speeds when hands are being dried and at lower speeds when in an air purification cycle. A bacteria or germ sensor could also be placed within the drying chamber or elsewhere on the lavatory system. The sensor could be operationally linked with an active air filter or purifier to initiate a filtration cycle.

In one embodiment of the invention, the nozzles 162, 164 are circular shaped but it is understood that the nozzle openings could have other types of shapes, such as ovals, trident, slots/slits, and the like. It is further contemplated that the nozzle body could have nozzle openings with different or non-uniform shapes and/or sizes. The lavatory system 10 could also be constructed so that the nozzles are oriented or angled at different areas within the drying chamber. Moreover, it is contemplated that the lavatory system 10 may have sensors within the drying chamber that detect the placement of the user's hands within the chamber. Selected ones of the nozzles could then be selectively opened and closed to direct drying air only through those nozzles that align with the placement of the user's hands within the drying chamber.

In yet another embodiment, the lavatory system 10 has a moisture detector or sensor that measures the wetness of the hands presented to the drying chamber. The run time and/or speed of the blower could be adjusted based on the detected hand wetness to optimize use of the hand dryer. In a similar manner, a sensor could be used to detect how sullied a user's hands are to control how much soap is dispensed by the soap dispenser and/or how much water is dispensed by the faucet.

In one embodiment of the lavatory system 10, a single drain 42 is used to drain water from the wash basin and drying chamber. Alternately, a second drain could be placed in the drying chamber.

Another alternate feature of the lavatory system 10 is the conversion of "wind" to electrical energy. This would allow air flow within the drying chamber to be collected, stored, and subsequently used to drive the blower motor. This could be accomplished by having air outlets within the drying chamber through which the blown air can pass to ultimately drive a small turbine or other device for the conversion of the wind energy to electrical energy.

As described herein, a motor driven blower or fan is used to force air into the drying zone of the hand dryer. It is recognized that several types of motors may be used to drive operation of the blower or fan. For example, in one embodiment, the motor is a brushless motor having a nominal input of 120V at 60 Hz. It is understood that the motor could have other operating parameters and that the motor could be designed to be workable with various input voltages, i.e., 230V, such as that commonly found in Europe and Australia.

It is preferred that the brushless motor has a pulse width modulated speed control to switch the motor between ON and OFF. It is also preferred that the motor is thermally protected against over-heating, such as may result from a blocked inlet, locked rotor, or heightened ambient temperature.

The invention is not limited to a particular motor size but in one embodiment the motor provides 78 cfm of air at 2.8 psi. Preferably, the motor accelerates from zero rpm to operating speed in approximately 350 ms or less. It is also contemplated that different fan types (e.g., axial, bypass, centrifugal compressor, etc.) may be used. An axial or turbine (volute) type pump is also preferred but not required. It is preferred that the fan has either an axial or tangential discharge air flow. It is also preferred that heat from the motor is used to increase the temperature of the air fed to the drying chamber. In addition to heating the air, passing the air about the motor also provides thermal regulation of the motor.

Thus, it is specifically intended that the present invention not be limited to the embodiments and illustrations contained herein, but includes modified forms of those embodiments including portions of the embodiments and combinations of elements of different embodiments as come within the scope of the following claims.

What is claimed is:

1. A lavatory system comprising:

a faucet extending from the lavatory system configured to dispense a water;

a soap dispenser attached to the lavatory system configured to dispense a liquid soap;

a hand dryer attached to the lavatory proximate the soap dispenser and including a first plenum outlet extending from a rear portion of the lavatory at a first height;

a basin attached to the lavatory system, configured to collect the water and the soap dispensed from the faucet and the soap dispenser, with a second plenum outlet incorporated in the basin at a second height lower than the first height, wherein the first plenum outlet and the second plenum outlet deliver a pressurized air to dry a user's hands; and a display incorporated in a portion of the lavatory system configured to display graphic or textual information to a user.

2. The lavatory system of claim 1, further comprising a sterilization feature attached to the lavatory system including ultraviolet light configured to sterilize at least one of the basin, the pressurized air, and the user's hands.

3. The lavatory system of claim 1 further comprising a noise cancellation system within the lavatory system configured to mitigate a sound of the operation of the hand dryer.

4. The lavatory system of claim 1 further comprising a system diagnostics system within the lavatory system with an integrated diagnostic data collection system programmed to collect and display a diagnostic data on the display including at least one of a hand dryer motor run time, a soap level, a period between a motor use cycles, a hand dryer air filter status, and an amount of water dispensed from the faucet.

5. The lavatory system of claim 4 further comprising a touch-sensitive sensor incorporated in the display configured to receive a manual input including operational parameters for the lavatory system including at least one of a motor run time, a faucet run time, and a volume of soap dispensed per cycle.

6. The lavatory system of claim 4 further including a communication system, configured to transmit the diagnostic data, in communication with a remote facility allowing a technician to remotely monitor the system diagnostics system.

7. The lavatory system of claim 3 wherein the noise cancellation system includes at least one of a mechanical noise cancellation device and an electrical noise cancellation device.

8. The lavatory system of claim 7 further comprising a sound amplifier connected to the noise cancellation system configured to provide noise cancellation.

9. The lavatory system of claim 7 further comprising a sound-absorbing material attached to the lavatory configured to provide mechanical noise cancellation.

10. The lavatory system of claim 1 further comprising a power circuit within the lavatory system configured to adapt to a plurality of different voltage inputs from a plurality of different countries and modify the voltage input to match a voltage requirement of a blower motor for the hand dryer and other electrical apparatuses.

11. The lavatory system of claim 2 wherein the sterilization features include a separate ultra violet chamber incorporating at least a portion of the basin configured to accept the user's hands.

12. The lavatory system of claim 1 further including a plurality of nozzles extending from the upper plenum outlet and the lower plenum outlet, wherein the nozzles include a non-uniform shape and a non-uniform size and wherein the nozzles are oriented in a plurality of angles.

13. The lavatory system of claim 1 further comprising a moisture detector proximate the hand dryer configured to measure a moisture level of the user's hands and determine a run time of the hand dryer.

14. The lavatory system of claim 1 further comprising a first drain in the basin below the faucet and a second drain in the basin below the upper plenum outlet.

15. A lavatory system comprising:

a faucet extending from the lavatory system configured to dispense a water;

a soap dispenser attached to the lavatory system configured to dispense a liquid soap;

a hand dryer attached to the lavatory proximate the soap dispenser and including a first plenum outlet extending from a rear portion of the lavatory at a first height;

a basin attached to the lavatory system, configured to collect the water and the soap dispensed from the faucet and the soap dispenser, with a second plenum outlet incorporated in the basin at a second height lower than the first height, wherein the first plenum outlet and the second plenum outlet deliver a pressurized air to dry a user's hands; and an electrical energy generator within the lavatory system configured to convert a kinetic energy from the pressurized air of the upper plenum outlet and the lower plenum outlet into an electrical energy.

16. The lavatory system of claim 15 further comprising:

a display mounted to an external portion of the lavatory system configured to display a graphic or a textual information to a user; and a system diagnostics system within the lavatory system with an integrated diagnostic data collection system programmed to collect and display a diagnostic data on the display including at least one of a hand dryer motor run time, a soap level, a period between motor use cycles, a hand dryer air filter status, and an amount of water dispensed from the faucet.

17. The lavatory system of claim 4 further comprising a touch-sensitive sensor incorporated in the display configured to receive a manual input including operational parameters for the lavatory system including at least one of a motor run time, a faucet run time, and a volume of soap dispensed per cycle.

18. The lavatory system of claim 17 further including:

a communication system configured to transmit the diagnostic data, in communication with a remote facility allowing a technician to remotely monitor the system diagnostics system; and a plurality of nozzles extending from the upper plenum outlet and the lower plenum outlet, wherein the nozzles include a non-uniform shape and a non-uniform size and wherein the nozzles are oriented in a plurality of angles.

19. The lavatory system of claim 16 further comprising:

a first drain in the basin below the faucet and a second drain in the basin below the upper plenum outlet; and an active noise cancelling device within the lavatory system with an electrical amplifier configured to provide noise cancellation.

20. A lavatory system comprising:

a faucet extending from the lavatory system configured to dispense a water;

a soap dispenser attached to the lavatory system configured to dispense a liquid soap;

a hand dryer attached to the lavatory proximate the soap dispenser and including a first plenum outlet extending from a rear portion of the lavatory at a first height;

a basin attached to the lavatory system, configured to collect the water and the soap dispensed from the faucet and the soap dispenser, with a second plenum outlet incorporated in the basin at a second height lower than the first height, wherein the first plenum outlet and the second plenum outlet deliver a pressurized air to dry a user's hands;

a display mounted to an exterior portion of the lavatory system configured to display a graphic or a textual information to a user;

a touch-sensitive sensor incorporated in the display configured to receive a manual input including operational parameters for the lavatory system including at least one of a motor run time, a faucet run time, and a volume of soap dispensed per cycle, a system diagnostics system within the lavatory system with an integrated diagnostic data collection system programmed to collect and display a diagnostic data on the display including at least one of a hand dryer motor run time, a soap level, a period between a motor use cycles, a hand dryer air filter status, and an amount of water dispensed from the faucet; and an electrical energy generator within the lavatory system configured to convert a kinetic energy from the pressurized air of the upper plenum outlet and the lower plenum outlet into an electrical energy.

* * * * *